US012704341B2

(12) United States Patent
Miller

(10) Patent No.: US 12,704,341 B2
(45) Date of Patent: Aug. 11, 2026

(54) SUPPRESSOR BAFFLE

(71) Applicant: Sig Sauer, Inc., Newington, NH (US)

(72) Inventor: Evan A. Miller, Exeter, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 18/428,649

(22) Filed: Jan. 31, 2024

(65) Prior Publication Data

US 2024/0410668 A1 Dec. 12, 2024

Related U.S. Application Data

(60) Provisional application No. 63/482,671, filed on Feb. 1, 2023.

(51) Int. Cl.
*F41A 21/30* (2006.01)

(52) U.S. Cl.
CPC ..... *F41A 21/30* (2013.01)

(58) Field of Classification Search
CPC ..... F41A 21/30
See application file for complete search history.

(56) References Cited

U.S. PATENT DOCUMENTS 5,029,512 A * 7/1991 Latka ..... F41A 21/30 89/14.4
7,237,467 B1 * 7/2007 Melton ..... F41A 21/34 89/14.4
7,308,967 B1 * 12/2007 Hoel ..... F41A 21/30 181/255
7,931,118 B1 * 4/2011 Cronhelm ..... F41A 21/30 89/14.4
8,100,224 B1 * 1/2012 Olson ..... F41A 21/30 181/267
9,395,136 B1 * 7/2016 Kovalov ..... F41A 21/30
9,857,137 B2 1/2018 Barrett
10,393,463 B1 8/2019 Sanders et al.
10,401,112 B2 9/2019 Barrett
10,480,888 B2 11/2019 Barrett
(Continued)

FOREIGN PATENT DOCUMENTS

WO WO-2020111950 A1 * 6/2020 ..... F41A 21/30

OTHER PUBLICATIONS

International Search Report and Written Opinion received for PCT/US2024/013781 (Nov. 5, 2024).
(Continued)

*Primary Examiner* — Derrick R Morgan
(74) *Attorney, Agent, or Firm* — Secant IP, P.L.L.C.

(57) ABSTRACT

A suppressor baffle includes a cone portion expanding along a central axis from a proximal end defining a projectile opening to an open distal end having an outer rim. The projectile opening is in an entrance plane oriented obliquely to the central axis. A first volume between a first side of the cone portion and a central plane that includes the central axis is smaller than a second volume between an opposite second side of the cone portion and the central plane. At least part of the outer surface of the second side of the cone portion has a convex profile as viewed along the central plane from a side of the suppressor baffle. In another example, a first part of the cone is axially offset from an opposite second part of the cone, resulting in a curved projectile opening profile and a curved outer rim profile.

16 Claims, 17 Drawing Sheets

(56) References Cited

U.S. PATENT DOCUMENTS

| | | | | |
|---|---|---|---|---|
| 11,255,623 | B2 | 2/2022 | Kras et al. | |
| 11,493,297 | B2 * | 11/2022 | Wilson | B23K 35/0238 |
| 2008/0148928 | A1 * | 6/2008 | Mcclellan | F41A 21/30 89/14.4 |
| 2015/0001001 | A1 * | 1/2015 | Wilson | F41A 21/36 219/76.1 |
| 2015/0308776 | A1 | 10/2015 | Smith | |
| 2016/0161203 | A1 * | 6/2016 | Wilson | B23K 35/3046 89/14.3 |
| 2016/0187093 | A1 * | 6/2016 | Barrett | F41A 21/30 89/14.4 |
| 2017/0067711 | A1 | 3/2017 | Slack | |
| 2017/0102202 | A1 * | 4/2017 | Augustine | F41A 21/30 |
| 2018/0058789 | A1 | 3/2018 | Dorne et al. | |
| 2018/0135932 | A1 * | 5/2018 | Tomczak | F41A 21/30 |
| 2018/0292160 | A1 | 10/2018 | Petersen | |
| 2018/0299223 | A1 * | 10/2018 | Barrett | F41A 21/30 |
| 2018/0313627 | A1 * | 11/2018 | Tomczak | F41A 21/30 |
| 2018/0313628 | A1 * | 11/2018 | Tomczak | F41A 21/30 |
| 2018/0321008 | A1 * | 11/2018 | Barney | F41A 21/30 |
| 2019/0063860 | A1 * | 2/2019 | Walker | F41A 21/30 |
| 2019/0186860 | A1 * | 6/2019 | Ellison | F41A 21/30 |
| 2019/0257608 | A1 * | 8/2019 | Hall | F41A 21/30 |
| 2020/0025491 | A1 * | 1/2020 | Petersen | B33Y 80/00 |
| 2020/0116450 | A1 * | 4/2020 | Ellison | F41A 21/30 |
| 2020/0173751 | A1 | 6/2020 | Dorne et al. | |
| 2020/0284541 | A1 | 9/2020 | Poling | |
| 2021/0018287 | A1 | 1/2021 | Kada et al. | |
| 2021/0041200 | A1 | 2/2021 | Kras et al. | |
| 2021/0180902 | A1 | 6/2021 | Bray et al. | |
| 2021/0396485 | A1 * | 12/2021 | Reis-Green | F41A 21/30 |
| 2022/0049920 | A1 | 2/2022 | Kras | |
| 2022/0057160 | A1 | 2/2022 | Johns et al. | |
| 2023/0175802 | A1 | 6/2023 | Bundy et al. | |
| 2023/0272991 | A1 * | 8/2023 | Petersen | F41A 21/30 181/223 |
| 2023/0392893 | A1 | 12/2023 | Sjögren | |
| 2024/0240896 | A1 * | 7/2024 | Ricci | F41A 21/30 |
| 2024/0288242 | A1 | 8/2024 | Kras et al. | |
| 2024/0328738 | A1 * | 10/2024 | Bundy | F41A 21/30 |
| 2024/0377153 | A1 * | 11/2024 | Lessard | F41A 21/30 |
| 2024/0410668 | A1 * | 12/2024 | Miller | F41A 21/30 |
| 2025/0189253 | A1 * | 6/2025 | Spector | F41A 21/30 |

OTHER PUBLICATIONS

Invitation to Pay Additional Fees received for PCT/US2024/013781, mailed Sep. 13, 2024.

International Search Report and Written Opinion for PCT/US2024/017254. Mailed Jun. 17, 2024.

* cited by examiner

SUPPRESSOR BAFFLE

RELATED APPLICATIONS

This application claims the benefit under 35 U.S.C. § 119(e) of U.S. Provisional Patent Application No. 63/482,671, titled SUPPRESSOR BAFFLE and filed on Feb. 1, 2023, the contents of which are incorporated herein by reference in its entirety.

FIELD OF THE DISCLOSURE

This disclosure relates generally to muzzle accessories for use with firearms and more particularly to a suppressor baffle and suppressor incorporating the same.

BACKGROUND

Design of firearms and related accessories involves many non-trivial challenges. For example, rifles, machine guns, and other firearms have faced particular challenges with reducing the audible and visible signature produced upon firing a round, while also maintaining the desired shooting performance. A suppressor is a muzzle accessory that reduces the audible report of the firearm by slowing the expansion and release of pressurized gases from the barrel. Visible flash can also be reduced by controlling the expansion of gases leaving the barrel as well as by controlling how muzzle gasses mix with ambient air.

SUMMARY

The present disclosure is directed to a suppressor baffle, a baffle stack, and a suppressor assembly including the at least one of the suppressor baffles or the baffle stack. In one aspect, a suppressor baffle has an asymmetrical cone geometry. For example, a suppressor baffle has a cone portion expanding along a central axis from a proximal end defining a projectile opening to an open distal end with an outer rim. The projectile opening is in an entrance plane oriented obliquely to the central axis. A first volume between a first side of the cone and a central plane that includes the central axis is smaller than a second volume between an opposite second side of the cone and the central plane. At least part of the second side of the cone portion has a convex profile as viewed along the central plane from a side of the suppressor baffle.

In another aspect, a suppressor baffle includes a cone expanding along a central axis from a proximal end that defines a projectile opening to an open distal end having an outer rim. The projectile opening is in an entrance plane oriented obliquely to the central axis. A first volume between a first side of the cone and a central plane that includes the central axis is smaller than a second volume between an opposite second side of the cone and the central plane. The first side of the cone is shifted or offset axially with respect to the second portion of the cone.

In another aspect, a baffle stack includes three or more baffles arranged along a central axis, where individual baffles have a cone portion expanding along a central axis from a proximal end to an open distal end having an outer rim, the proximal end defining a projectile opening contained in a plane that is oriented obliquely to the central axis so as to define an angle $\alpha$ with the central axis as viewed from a side of the baffle stack. The three or more baffles include a first baffle defining a first angle $\alpha 1<90°$, a second baffle located distally of the first baffle and defining a second angle $\alpha 2<\alpha 1$, and a third baffle located distally of the second baffle and defining a third angle $\alpha 3<\alpha 2$.

Numerous variations and embodiments will be apparent in light of the present disclosure.

Figure 1A:
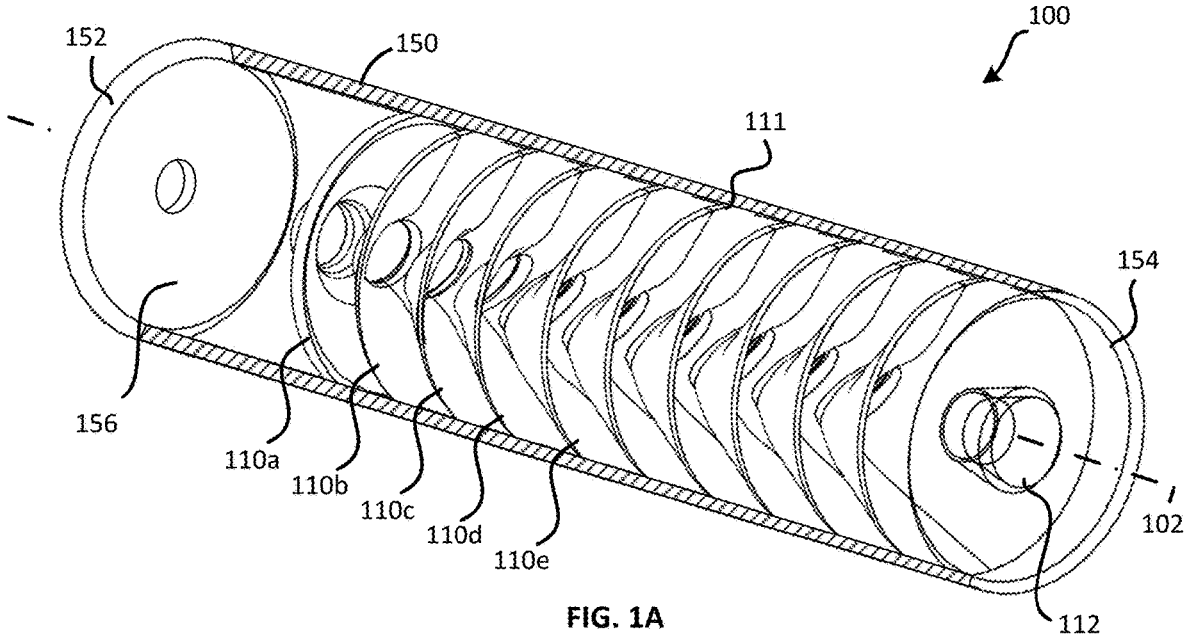
FIG. 1A illustrates a perspective view of a suppressor assembly with a baffle stack and outer housing, where the outer housing is illustrated as being transparent, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a suppressor baffle, baffle stack, and a suppressor assembly. In one example embodiment, a suppressor baffle has an asymmetrical shape, such as one having an appearance of a frustocone that has been distorted. In one example, one side of the baffle cone is expanded rearward to result in an elliptical projectile opening that is oriented obliquely to the central axis, yet has a circular shape as viewed along the central axis. A side of the baffle cone (e.g., lower portion) adjacent the rearward-most portion of the projectile opening is expanded radially away (e.g., downward) from the central axis to increase the volume of this part of the cone. The orientation and shape of the projectile opening and shape of the cone promotes gas flow in an off-axis direction through the opening and towards the region of the cone having expanded volume.

In another example embodiment, one side of the baffle cone is shifted axially compared to the opposite side of the baffle cone, resulting in offset, curved profile at the projectile opening as viewed from the side. The baffle's outer rim at the distal end can also have an offset shape similar to that of the projectile opening.

In another example, a baffle stack includes three or more baffles that each have a projectile opening in a plane arranged obliquely to the central axis. The angle defined between the plane of the projectile opening and the central axis is smaller for a baffle downstream of another baffle. In a baffle stack with three or more baffles, the angle may decrease for successive baffles.

When used in a suppressor, a baffle cone or baffle stack as disclosed herein advantageously can improve flash attenuation without a significantly affecting sound attenuation performance. For example, embodiments disclosed herein provide a projectile opening of in the distal wall of the suppressor that is sized close the projectile diameter, and therefore is effective to reduce the visible signature.

General Overview

As noted above, non-trivial issues may arise that complicate weapons design and performance of firearms. For instance, one non-trivial issue pertains to the fact that the discharge of a firearm normally produces an audible and visible signature resulting from rapidly expanding propellant gases and from the projectile leaving the muzzle at a velocity greater than the speed of sound. It is generally understood that attenuating the audible report may be accomplished by slowing the rate of expansion of the propellant gases. Reducing the visible signature or visible flash also can be accomplished by controlling the expansion of gases exiting the muzzle. Reducing flash is a function of temperature, pressure, barrel length, and the type of ammunition being fired, among other factors. However, successfully attenuating muzzle flash can adversely affect the performance of sound attenuation and vice versa. For example, a design optimized to attenuate the audible signature may not be effective at attenuating the visible signature, or vice versa. Additionally, some designs may result in particle buildup inside the suppressor or may result in backflow of combustion gases towards the operator.

Thus, reducing the visible signature while also reducing the audible signature of a firearm presents non-trivial challenges. To address these challenges and others, and in accordance with some embodiments, the present disclosure relates to a suppressor baffle, a baffle stack, and a suppressor incorporating the baffle.

Compared to existing baffle-type suppressors, baffles and suppressors of the present disclosure can provide comparable performance (or better) for reducing the audible report of the firearm while also providing improved flash attenuation.

A suppressor assembly, a baffle stack, or individual baffles of the present disclosure can be manufactured by molding, casting, machining, 3-D printing, or other suitable techniques. For example, additive manufacturing—also referred to as 3-D printing—can facilitate manufacture of complex geometries that would be difficult or impossible to make using conventional machining techniques. One additive manufacturing method is direct metal laser sintering (DMLS). In one embodiment, a suppressor assembly with a distal wall, an outer housing, and a plurality of baffles within the outer housing can be made using DMLS techniques, where these components are formed together as a single monolithic structure.

As will be appreciated in light of this disclosure, and in accordance with some embodiments, a suppressor assembly configured as described herein can be utilized with any of a wide range of firearms, such as, but not limited to, bolt-action rifles, machine guns, semi-automatic and automatic rifles, short-barreled rifles, submachine guns, and pistols. Some embodiments of the present disclosure are particularly well suited for use with a bolt-action rifle. Suitable host firearms and projectile calibers will be apparent in light of this disclosure.

Note that suppressor baffles are shown and described as having as top and bottom portions. However, these references are used for convenience to describe the illustrations and a given baffle is not required to have any particular rotational orientation about the central axis. In addition, although generally referred to a suppressor herein for consistency and case of understanding the present disclosure, the disclosed suppressor is not limited to that specific terminology and alternatively can be referred to as a silencer, sound attenuator, a sound moderator, a signature attenuator, a flash attenuator, or other terms. Also, although generally referred to herein as a baffle cone, the disclosed baffle cones are not limited to that specific terminology and alternately can be referred to, for example, as a baffle wall, a baffle, or other terminology, regardless of whether the baffle cone has a true conical geometry or not. Numerous configurations will be apparent in light of this disclosure.

Example Suppressor Configurations

Figure 1B:
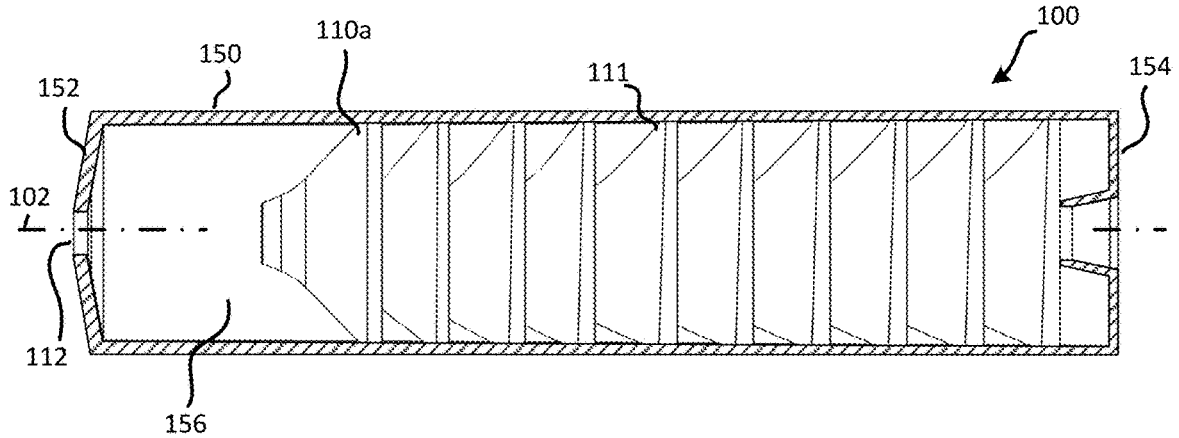
FIG. 1B is a side view of the suppressor assembly of FIG. 1A.

FIG. 1A illustrates a perspective view of a suppressor assembly 100 that includes a baffle stack 111 with a plurality of baffles 110 retained in an outer hosing 150, where the outer housing 150 is illustrated as being transparent, in accordance with an embodiment of the present disclosure. FIG. 1B is a side view of the suppressor assembly 100 of FIG. 1A. The suppressor outer housing 150 extends along a central axis between a proximal wall 152 and a distal wall 154. The proximal wall 152, distal wall 154, and each baffle defines a projectile opening 112 aligned with the central axis 102 for passage of a projectile. Note that the first baffle 110*a* is axially spaced from the proximal wall 152, thereby defining a blast chamber 156 in a proximal portion of the outer housing 150. In some embodiments, the blast chamber 156 can be sized to receive a muzzle attachment, such as a flash hider, muzzle brake, or muzzle adapter.

Figure 2A:
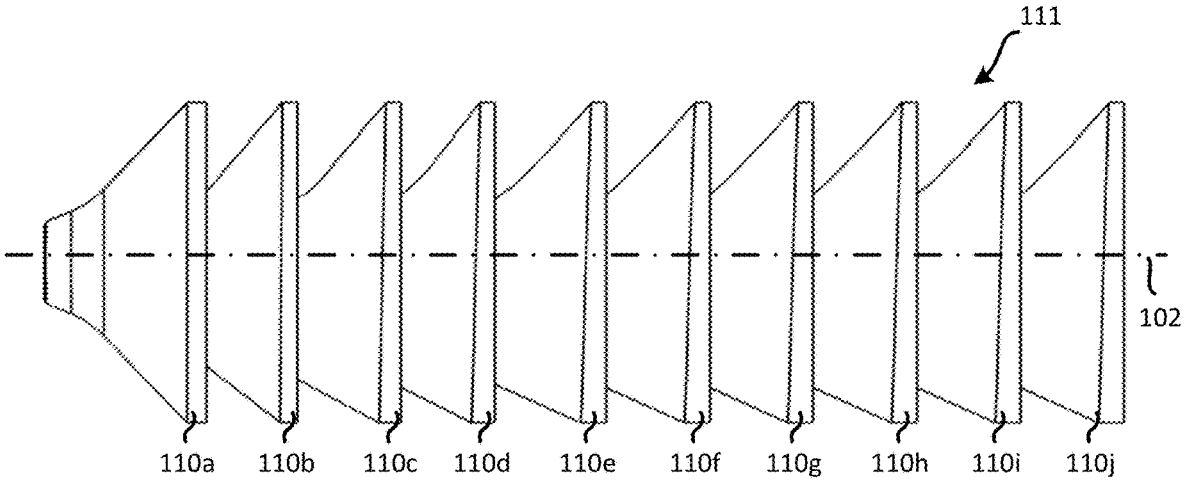
FIG. 2A illustrates a side view of a suppressor baffle stack, in accordance with an embodiment of the present disclosure.
Figure 2B:
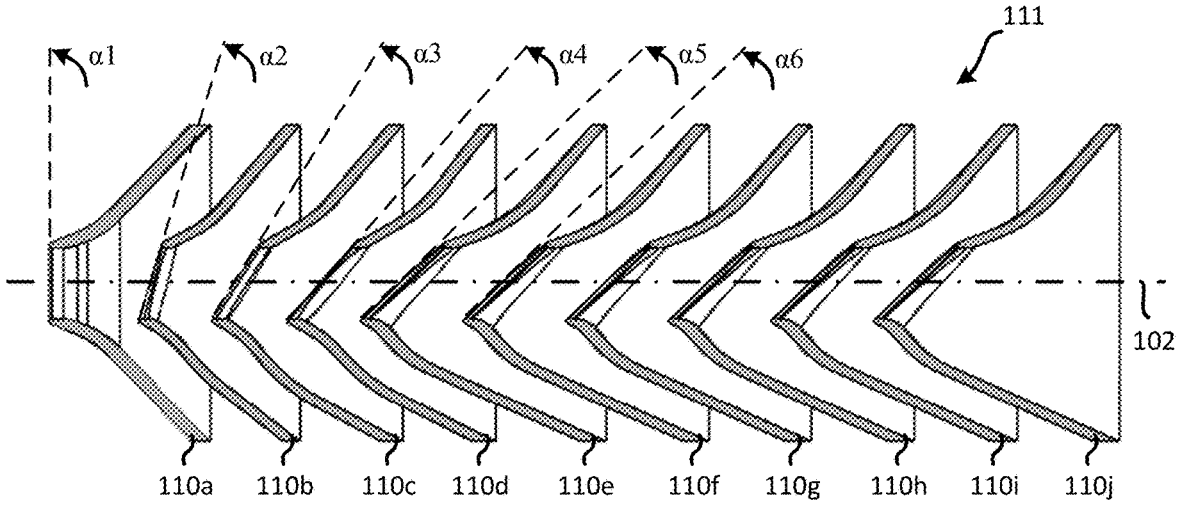
FIG. 2B illustrates a side view showing a longitudinal section of the baffle stack of FIG. 2A.

FIG. 2A illustrates a side view of the baffle stack 111 shown in FIGS. 1A-1B, in accordance with an embodiment of the present disclosure. FIG. 2B illustrates a side view showing a longitudinal section of the baffle stack 111. The baffle stack 111 includes first baffle 110*a* (sometimes referred to as a proximal baffle 110*a* or blast baffle 110*a*), a plurality of intermediate baffles 110*b*-110*i*, and a distal baffle 110*j*. In in this example, the baffle stack 111 includes eight intermediate baffles 110*b*-110*i*, although the baffle stack 111 can have more or fewer intermediate baffles as deemed suitable to meet particular performance objectives. The projectile opening 112*a* of the first baffle 110*a* is in a plane that is perpendicular to the central axis 102. The projectile opening 112 of each intermediate baffles 110*b*-110*i* and of distal baffle 110*j* is in a plane that is inclined with respect to the central axis 102. As can be seen in the cross-sectional view of FIG. 2B, the projectile opening 112 of the intermediate and distal baffles 110*b*-110*j* is more inclined that the projectile opening 112 of the proximally adjacent baffle.

For example, the projectile opening 112 of the first baffle 110*a* is perpendicular to the central axis 102, defining a first plane angle $\alpha 1$ of 90°, the projectile opening 112*b* of the second baffle 110*b* defines a second plane angle $\alpha 2$ that is less than the first plane angle $\alpha 1$ (e.g., about 75°), the projectile opening 112 of the third baffle 110*c* defines a third plane angle $\alpha 3$ that is less than the second plane angle $\alpha 2$ (e.g., about 60°), the projectile opening 112*d* of the fourth baffle 110*d* defines a fourth plane angle $\alpha 4$ that is less than the third plane angle $\alpha 4$ (e.g., about 50°), and the projectile opening 112*e* of the fifth baffle 110*e* defines a fifth plane angle $\alpha 5$ that is less than the fourth plane angle $\alpha 4$ (e.g., about 45°); the projectile opening 112 of subsequent intermediate baffles 110*f*-110*i* and distal baffle 110*j* also define an angle $\alpha 6$ substantially equal to the fifth plane angle $\alpha 5$ (about 45°). Thus, the plane angle $\alpha$ of at least some subsequent baffles are inclined to the central axis 102 to an increasing amount compared to the proximally adjacent baffle 110. That is, for at least some of the baffles located distally of the first baffle 110*a*, the projectile opening 112 defines a plane angle $\alpha$ that continues to decrease moving distally.

Note in this example that the baffles 110 of the baffle stack 111 are nested such that the projectile opening 112 of each baffle 110 is positioned within the cone of the preceding baffle 110. That is, the projectile opening 112 of one baffle 110 is within the volume of the expanding wall of a preceding baffle 110. Also note that individual baffles 110 of the baffle stack 111 have the same rotational orientation about the central axis 102. The orientation of the baffle stack 111 is arbitrary and in other embodiments the baffle stack 111 as a whole or individual baffles 110 of the baffle stack 111 can have different rotational orientations about the central axis 102 that what is shown.

Figure 3A:
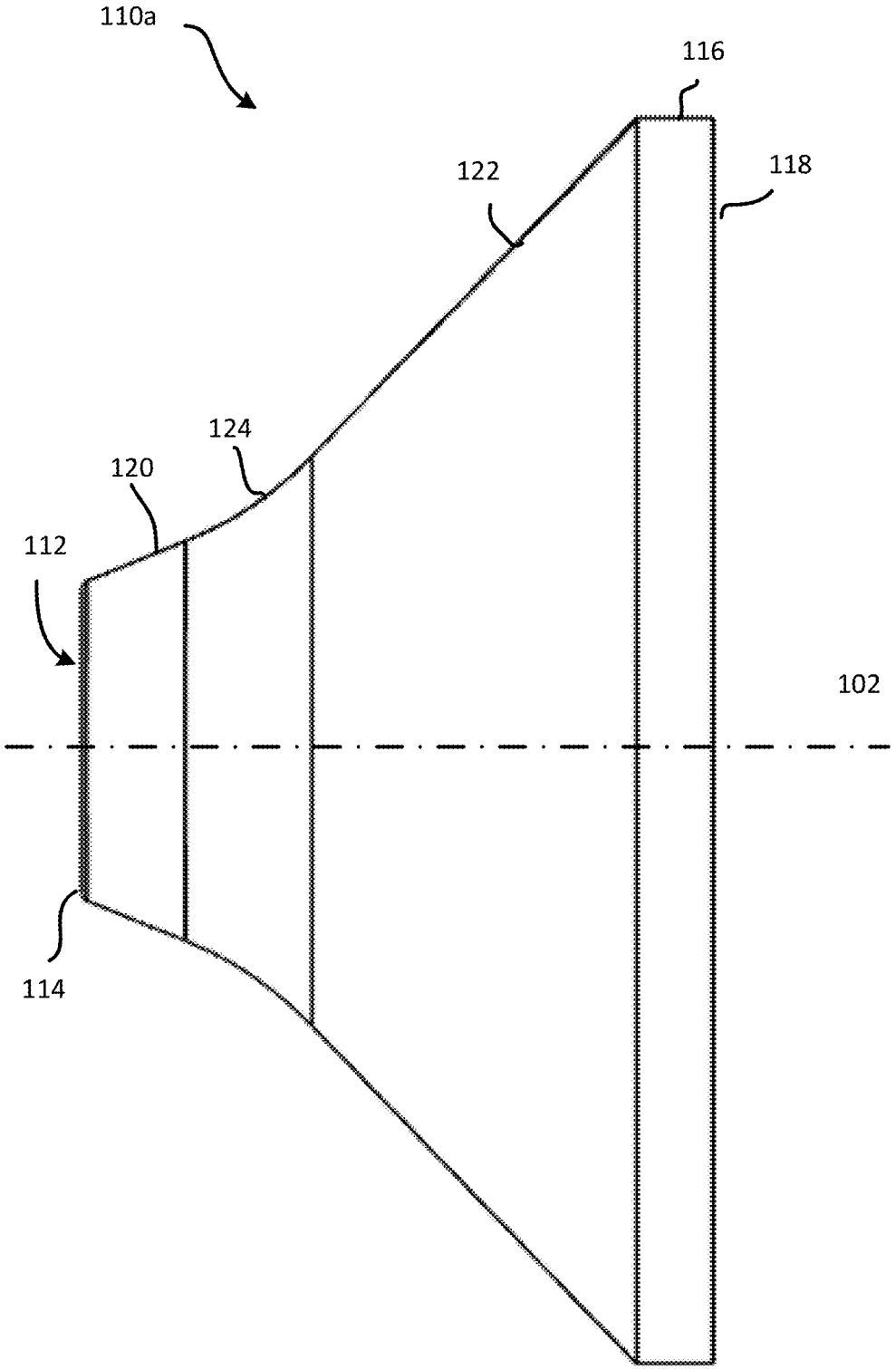
FIG. 3A illustrates a side view of a first suppressor baffle, in accordance with an embodiment of the present disclosure.
Figure 3B:
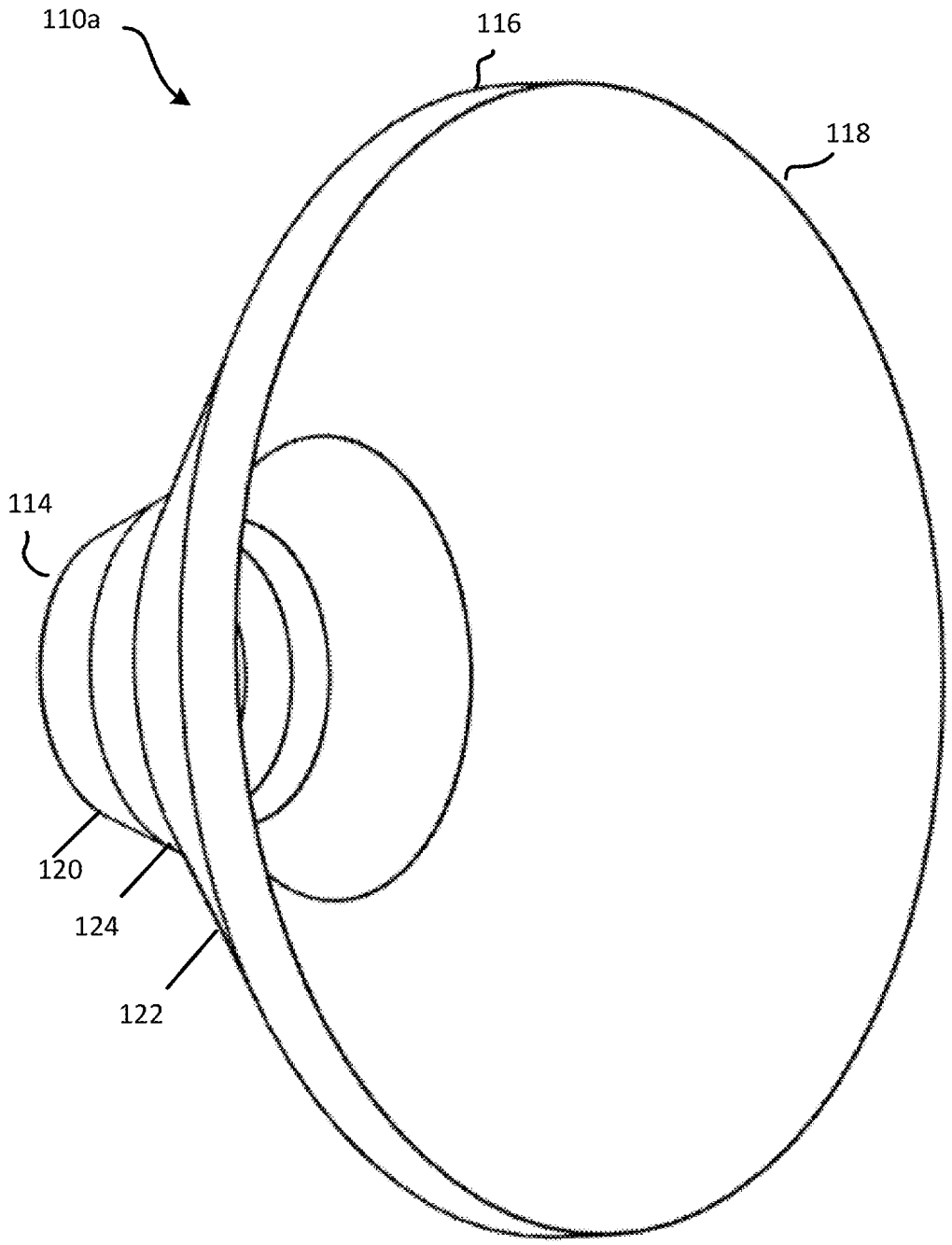
FIG. 3B illustrates a front perspective view of the suppressor baffle of FIG. 3A.

FIG. 3A illustrates a side view of a blast baffle 110*a* or first baffle 110*a*, in accordance with an embodiment of the present disclosure. FIG. 3B illustrates a front perspective view of the first baffle 110*a* of FIG. 3A. In this example, the first baffle 110*a* extends along the central axis 102 and expands from a projectile opening 112 at the proximal end 114 to an outer rim 116 at the distal end 118. In doing so, the first baffle 110*a* has a first region 120 with a slope of about 15-25° to the central axis 102 and a second region 122 with a slope of about 50-60°. In some embodiments, the first region 120 and/or second region 122 has a linear or substantially linear profile connected by an arcuate transition 124. The first baffle 110*a* is symmetrical about the central axis 102, which has shown to eliminate or reduce the effect of propellant gases on the projectile's flight through the first baffle 110*a*. The projectile opening 112 has a circular shape that is perpendicular to the central axis 102. The distal end 118 defines a plane that is perpendicular to the central axis 102. Stated differently, the outer rim 116 is coaxially arranged with the central axis 102.

Figure 4A:
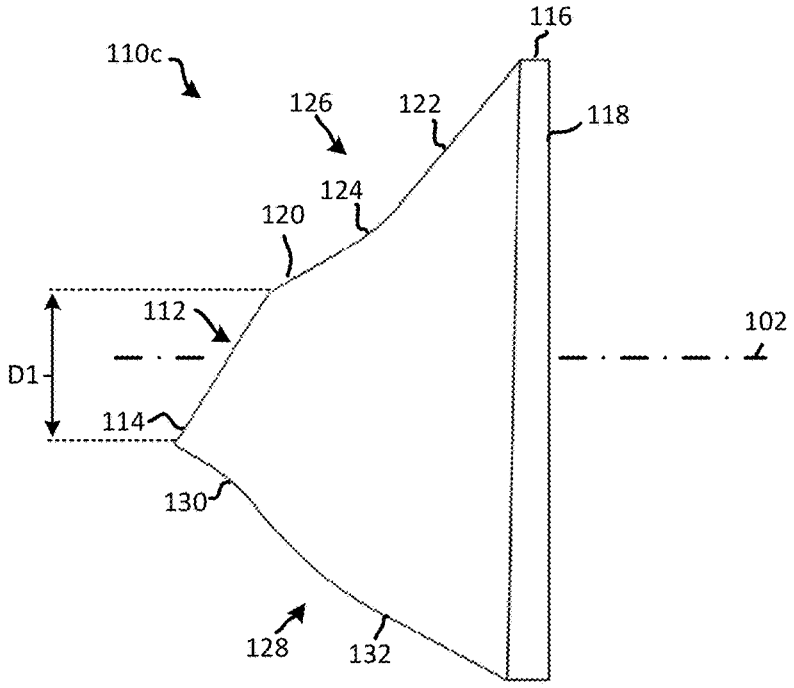
FIG. 4A illustrates a side view of a suppressor baffle from an intermediate portion of the baffle stack shown in FIGS. 1A-1B, in accordance with an embodiment of the present disclosure.
Figure 4B:
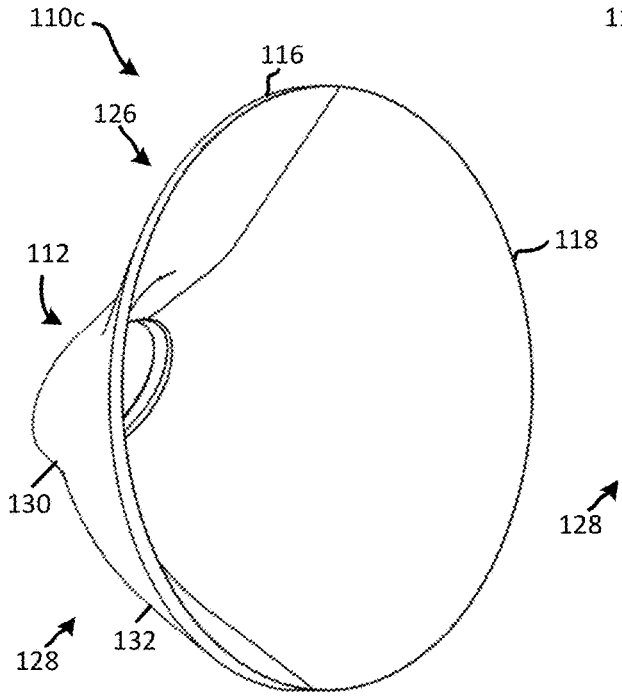
FIG. 4B illustrates a front perspective view of the suppressor baffle of FIG. 4A.
Figure 4C:
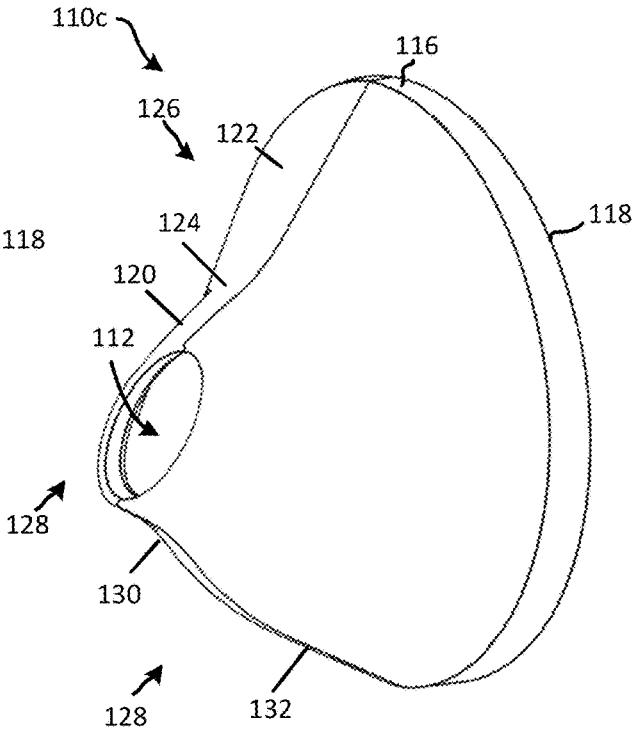
FIG. 4C illustrates a top and rear perspective view of the suppressor baffle of FIG. 4A.
Figure 4D:
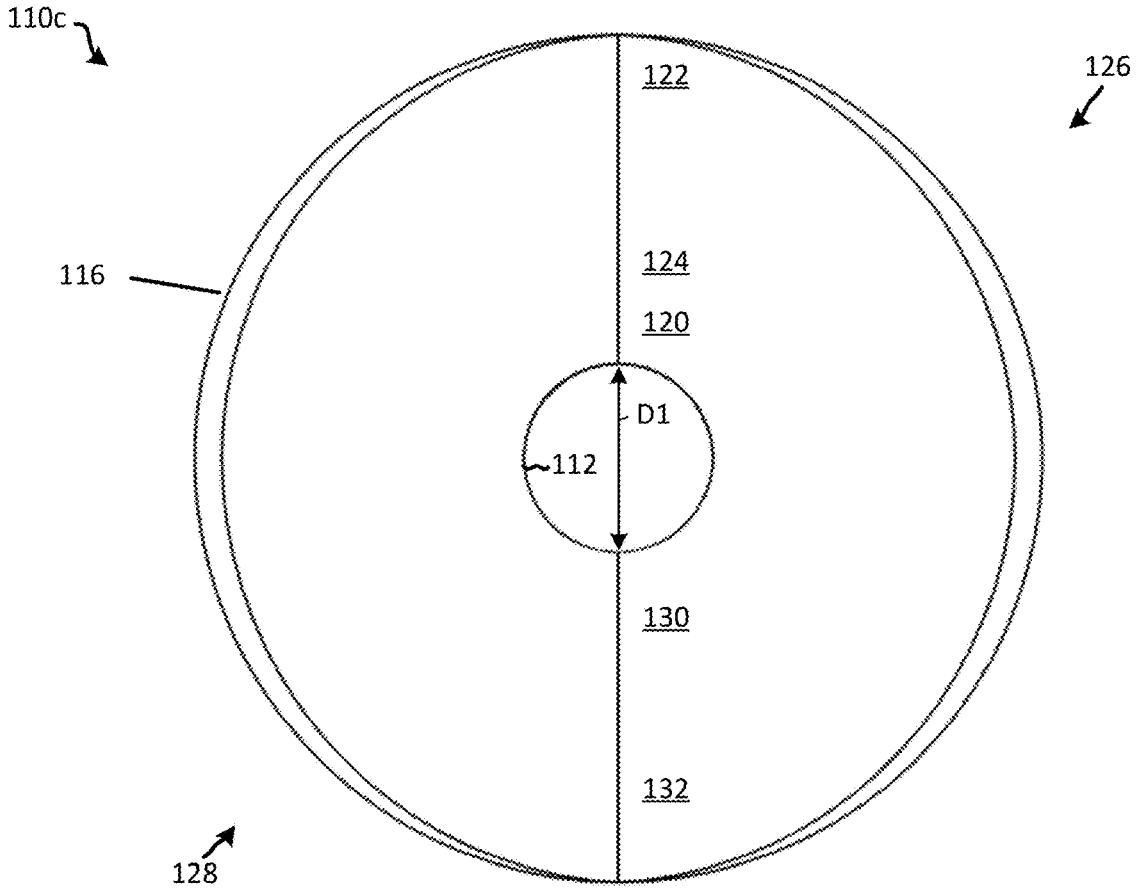
FIG. 4D illustrates a rear view showing the suppressor baffle of FIG. 4A as viewed along the central axis.
Figure 4E:
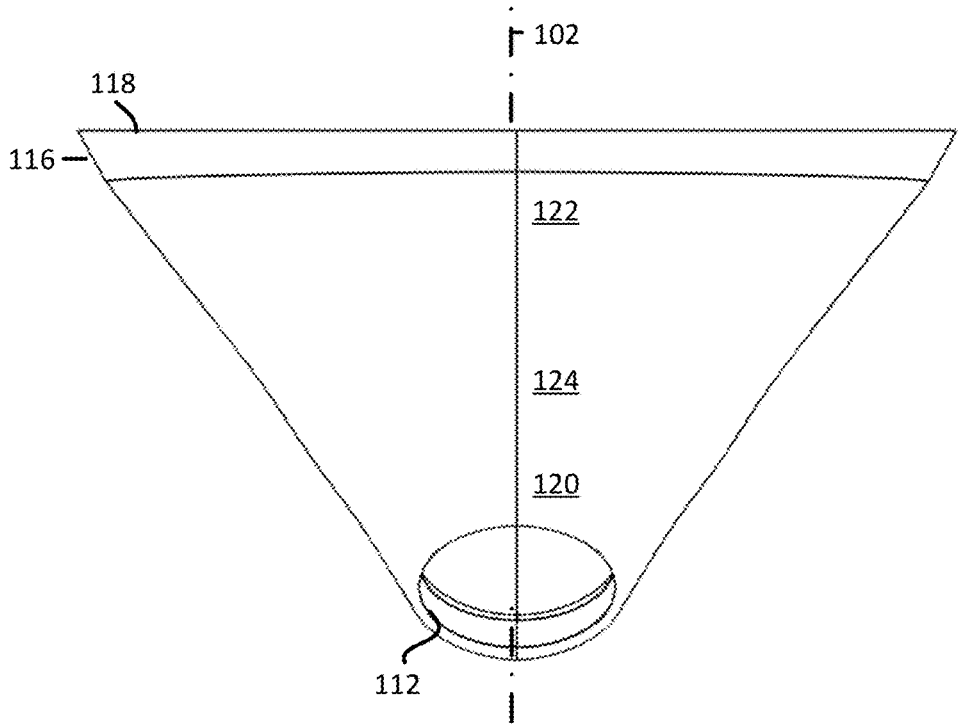
FIG. 4E illustrates a top view of the suppressor baffle of FIG. 4A.

FIGS. 4A-4E illustrate various views of an intermediate baffle 110, such as the third baffle 110*c* shown in FIG. 2A, in accordance with an embodiment of the present disclosure. FIG. 4A is a side view, FIG. 4B is a front perspective view, FIG. 4C is a rear perspective view, FIG. 4D is a rear view, and FIG. 4E is a top view. These figures are discussed concurrently. The third baffle 110*c* extends along the central axis 102 and expands in size and volume from a projectile opening 112 at the proximal end 114 to an outer rim 116 at the distal end 118. The distal end 118 defines a plane that is perpendicular to the central axis 102.

On a first side 126 (e.g., top as illustrated), the third baffle 110*c* has a first region 120 with a slope of about 25-35° to the central axis 102 and a second region 122 with a slope of about 45-55°, where the first region 120 and second region 122 have a substantially linear profile joined by an arcuate transition 124. The opposite second side 128 (e.g., bottom as illustrated) of the third baffle 110*c* extends from the projectile opening 112 along a concave section 130 having an average slope from −35° to −45° that transitions to a substantially linear section 132 having a slope from −25° to −35°. Compared to the first baffle 110*a*, the second side 128 (e.g., bottom) of the third baffle 110*c* has been expanded and/or shifted rearward and radially outward so that the projectile opening 112 is inclined at an angle from 55° to 65° to the central axis 102. Also, the second side 128 has an overall convex profile compared to the first side 126, which has an overall concave profile. The result is an increased volume inside of the second side 128 compared to the first side 126. In combination with the inclined projectile opening 112, the increased volume of the second side 128 promotes off-axis gas flow into the second side 128. Note that as viewed along the central axis 102, such as shown in FIG. 4D, the projectile opening 112 has a circular shape even though the actual shape is elliptical or elongated as viewed perpendicular to the plane of the projectile opening 112. This circular shape has a projected diameter D1.

Figure 5A:
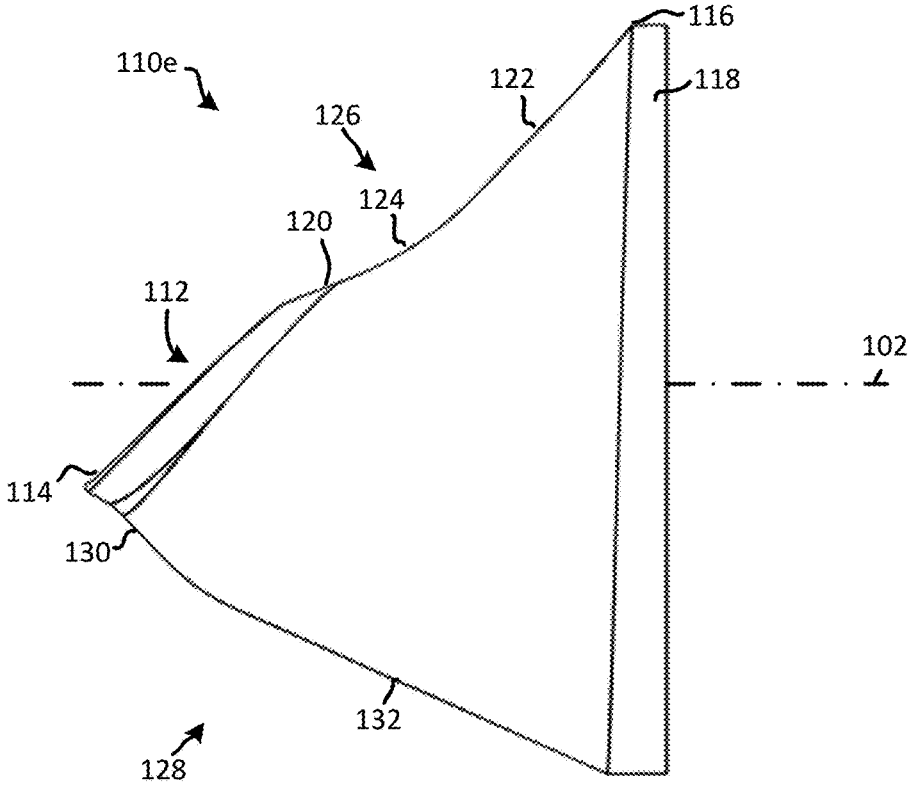
FIG. 5A illustrates a side view of a suppressor baffle from a distal end of the baffle stack, in accordance with an embodiment of the present disclosure.
Figure 5B:
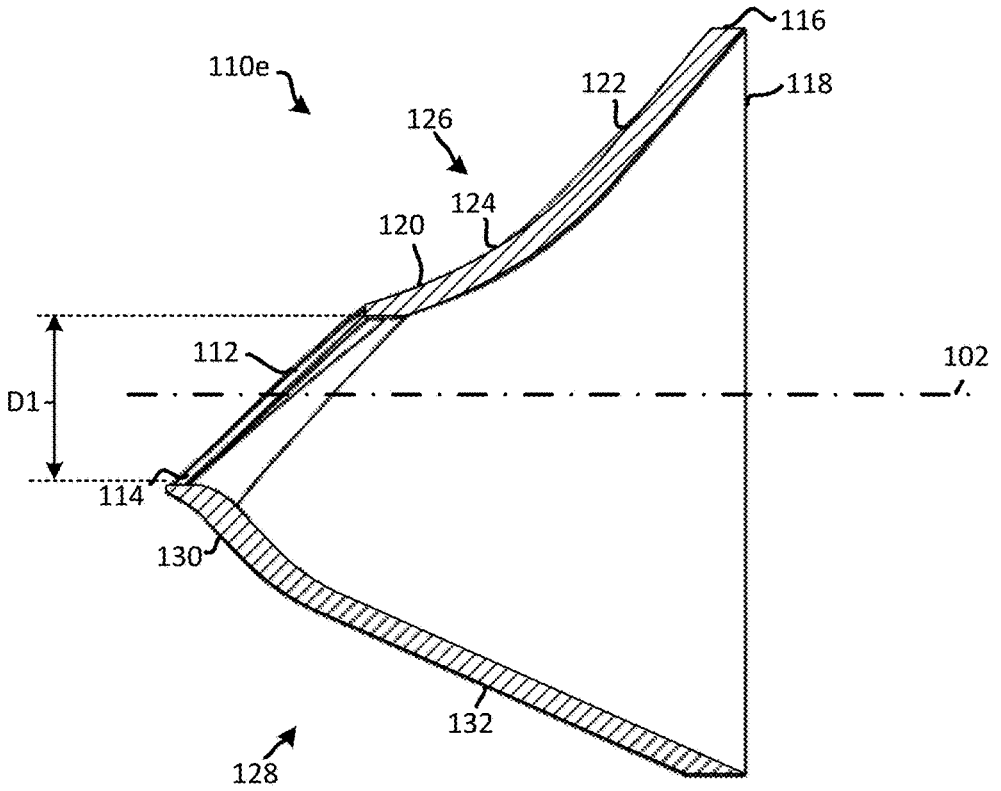
FIG. 5B illustrates a side view showing a longitudinal section of the suppressor baffle of FIG. 5A.
Figure 5C:
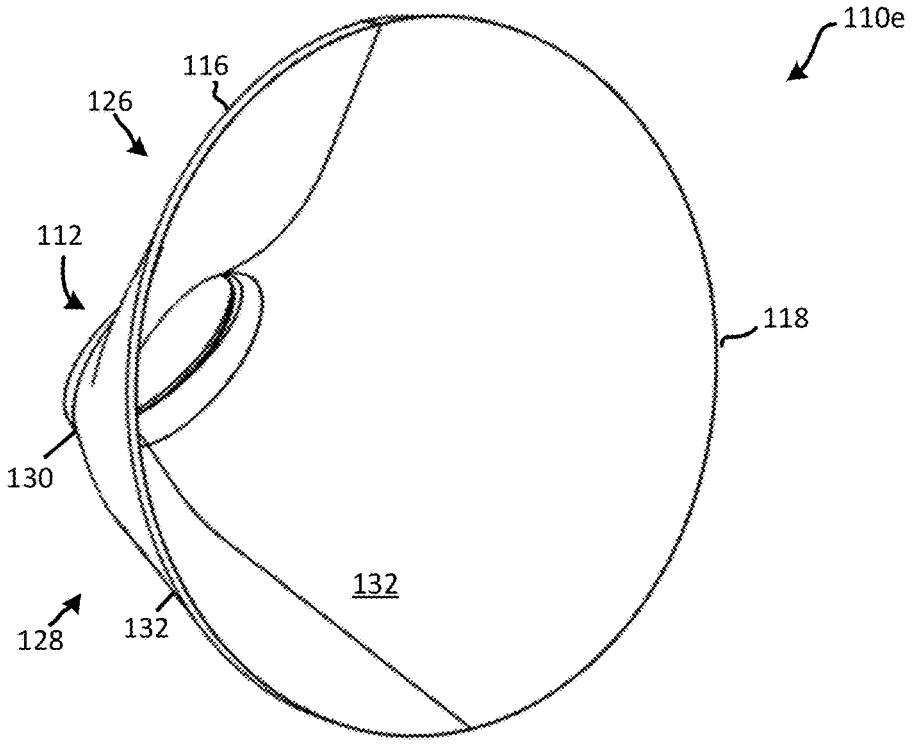
FIG. 5C illustrates a front perspective view of the suppressor baffle of FIG. 5A.
Figure 5D:
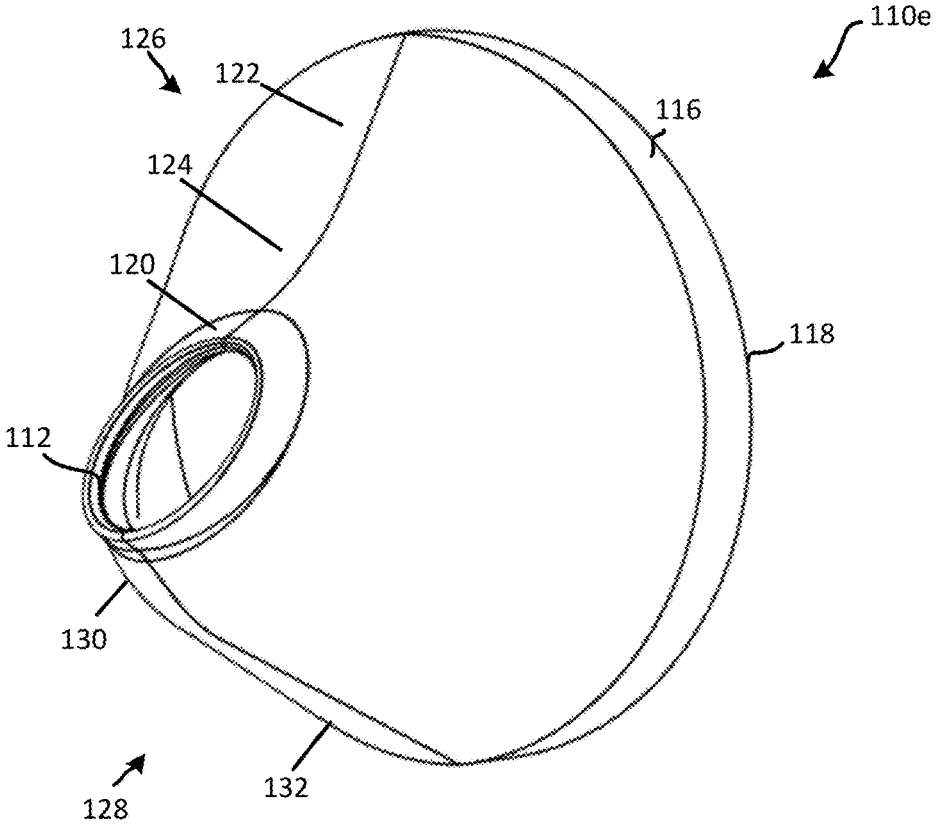
FIG. 5D illustrates a rear perspective view of the suppressor baffle of FIG. 5A.

FIGS. 5A-5D illustrate various views of another intermediate baffle 110, such as the fifth baffle 110*e* as shown in the baffle stack 111 of FIG. 2A, in accordance with an embodiment of the present disclosure. FIG. 5A is a side view, FIG. 5B is a side cross-sectional view, FIG. 5C is a front perspective view, and FIG. 5D is a rear perspective view. These figures are discussed concurrently. Note that the fifth baffle 110*e* is also representative of intermediate baffles 110*f*-110*h* and of distal baffle 110*i* shown in the example of FIGS. 2A-2B.

The fifth baffle 110*e* expands along the central axis 102 from a projectile opening 112 at the proximal end 114 to an outer rim 116 at the distal end 118. The distal end 118 defines a plane that is perpendicular to the central axis 102 and the outer rim 116 is coaxially arranged with the central axis 102. The projectile opening 112 defines a plane that is obliquely oriented to the central axis 102. On a first side 126 (e.g., top as shown), the fifth baffle 110*e* has a first region 120 having a slope of about 15-25° to the central axis 102 and a second region 122 having a slope of about 45-55°, where the first region 120 and second region 122 have a substantially linear profile joined by an arcuate transition 124. The opposite second side 128 (e.g., bottom) of the fifth baffle 110*c* extends from the projectile opening 112 along a concave section 130 having an average slope from −35° to −45° and that transitions to a substantially linear section 132 having a slope from −20° to −30°.

Compared to the third baffle 110*c*, the second side 128 (e.g., bottom) of the fifth baffle 110*e* has been expanded further rearward so that the projectile opening 112 is inclined at a plane angle from 30° to 40°. Also, the concave section 130 of the second side 128 is located closely adjacent the projectile opening 112 and has a reduced length so that the concave section 130 approximates a linear section. The linear section 132 is longer than in the third baffle 110*c* and is the predominant appearance of the second side 128 in this example. The second side 128 has an overall linear profile that extends to the outer rim 116 at a relatively shallow angle, compared to the first side 126, which has an overall concave profile that extends to the outer rim 116 at a relatively steep angle. The result is an increased volume inside of the second side 128 compared to the first side 126. In combination with the inclined projectile opening 112, the increased volume of the second side 128 promotes off-axis gas flow into the volume of the second side 128. Note that as viewed along the central axis 102 (similar to as shown in FIG. 4D), the projectile opening 112 has a circular shape even though the actual shape is elliptical or elongated as viewed perpendicularly to the plane of the projectile opening 112. The projectile opening 112 has a projected diameter D1 of the circular shape as viewed along the central axis 102.

Figure 6A:
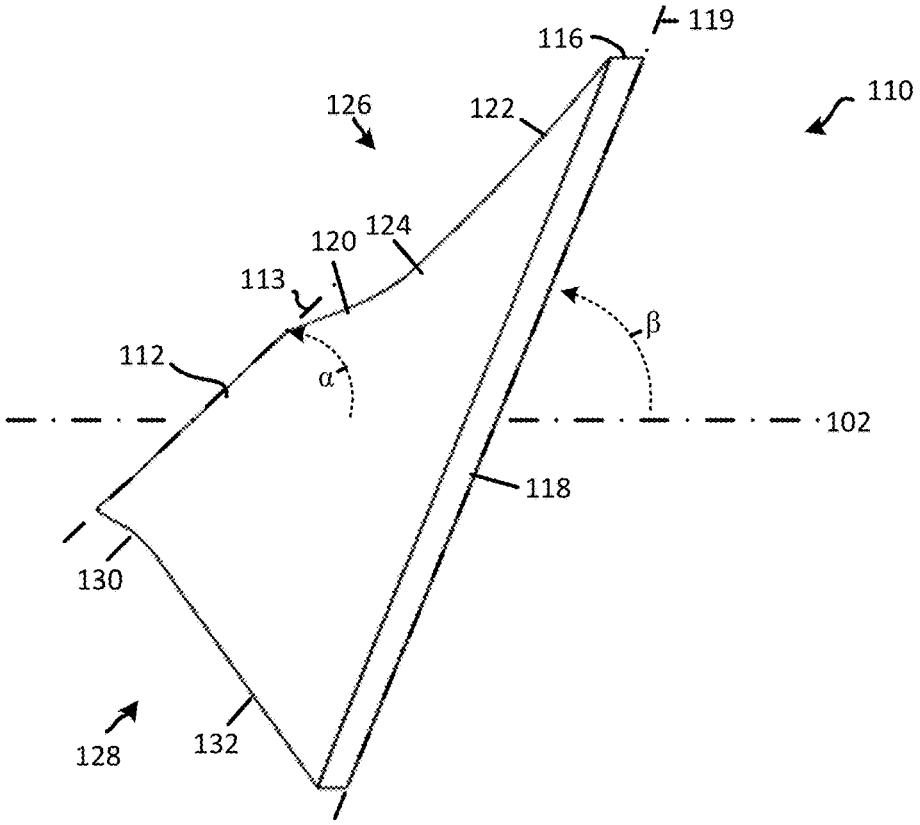
FIG. 6A illustrates a side view of a suppressor baffle, in accordance with another embodiment of the present disclosure.
Figure 6B:
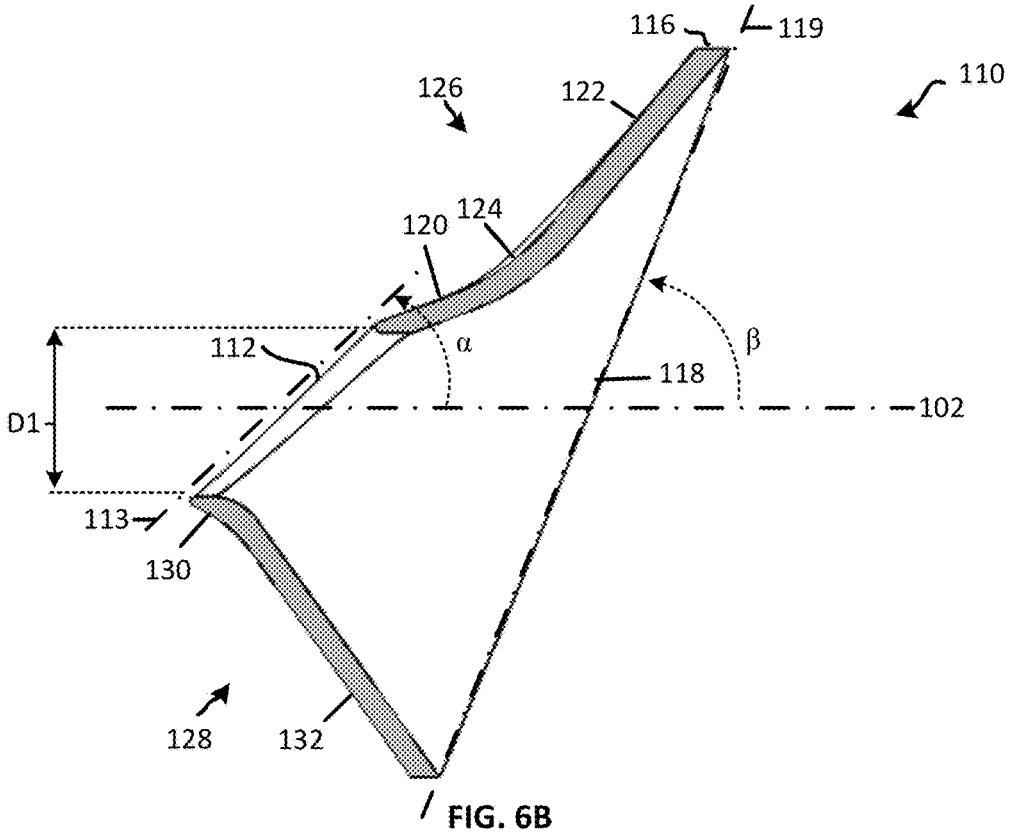
FIG. 6B illustrates a side view showing a longitudinal section of the suppressor baffle of FIG. 6A.
Figure 6C:
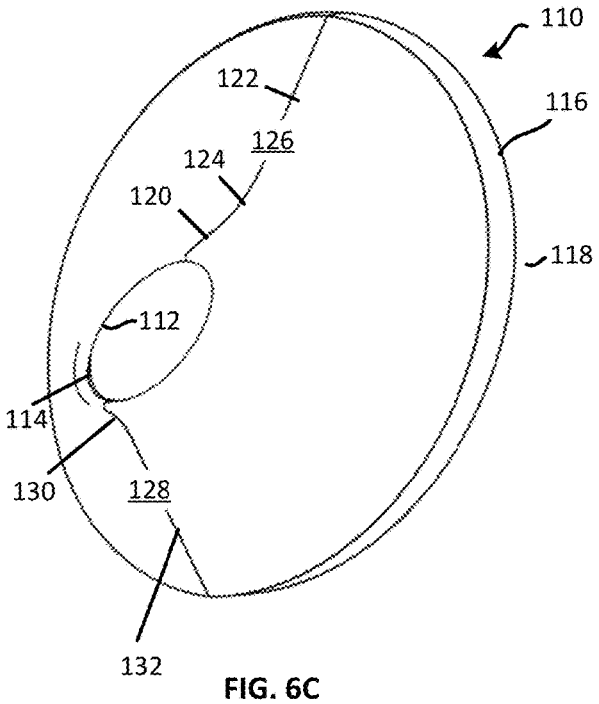
FIG. 6C illustrates a rear perspective view of the suppressor baffle of FIG. 6A.
Figure 6D:
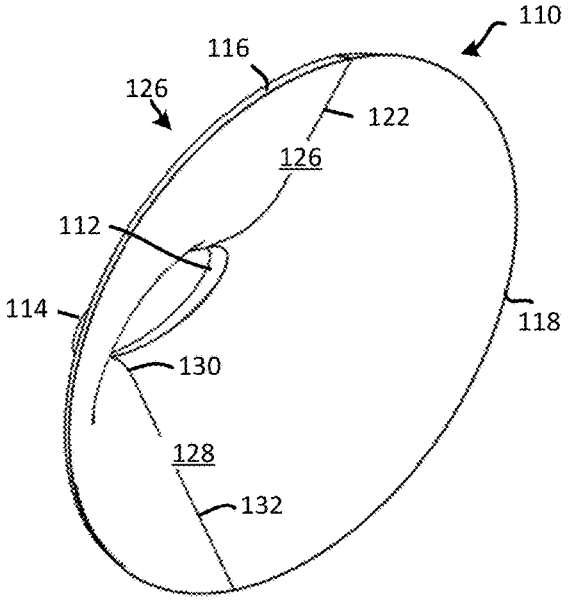
FIG. 6D illustrates a front perspective view of the suppressor baffle of FIG. 6A.
Figure 6E:
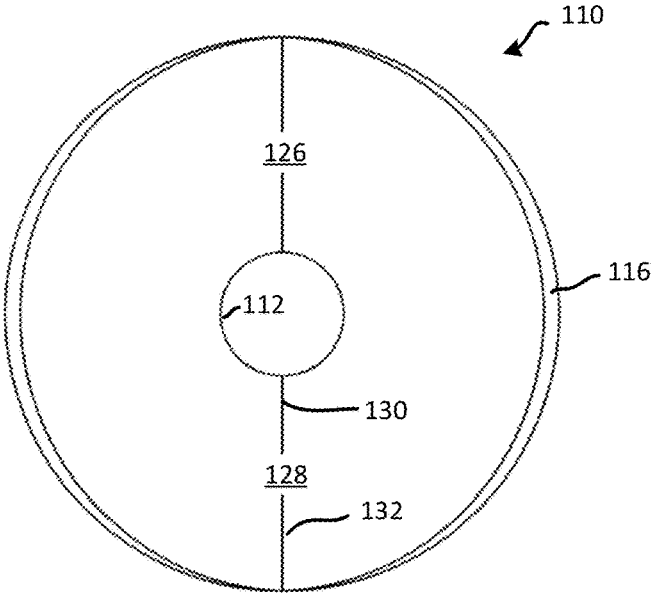
FIG. 6E illustrates a rear view of the suppressor baffle of FIG. 6A as viewed along the central axis.

FIGS. 6A-6D illustrate views of a suppressor baffle 110, in accordance with another embodiment of the present disclosure. FIG. 6A is a side view, FIG. 6B is a side view showing a longitudinal section of the baffle 110 of FIG. 6A, FIG. 6C is a rear perspective view, FIG. 6D is a front perspective view, and FIG. 6E is a rear view along the central axis 102. In this example, the baffle 110 expands along the central axis 102 from a projectile opening 112 at the proximal end 114 to an outer rim 116 at the distal end 118. The distal end 118 defines an exit plane 119 that is inclined or obliquely oriented to the central axis 102 at an angle β from 65° to 75°, or about 70°. Accordingly, the outer rim 116 is aligned along the exit plane 119. The projectile opening 112 defines an entrance plane 113 that is inclined or obliquely oriented to the central axis 102 at a plane angle α from 40°-50° or about 45°. The projectile opening 112 has a circular shape as viewed along the central axis 102. The projectile opening has a projected diameter D1.

The first side 126 of the baffle 110 (e.g., top side) has a relatively short first region 120 that transitions at transition 124 to second region 122, where first region 120 and second region 122 have a substantially linear profile. In this example, the first side 126 curves upward and extends along second region 122 at an angle of about 45° to the central axis 102. The opposite second side 128 (e.g., bottom side) includes a relatively small concave section 130 that connects to a linear section 132 that is inclined away from the central axis 102 at about −55°. As can be seen in the side views of FIGS. 6A-6B, the volume of the first side 126 is smaller than a volume of the second side 128. In combination with the oblique orientation of the projectile opening 112, the larger volume of the second side 128 promotes gas flow towards this volume.

Figure 7A:
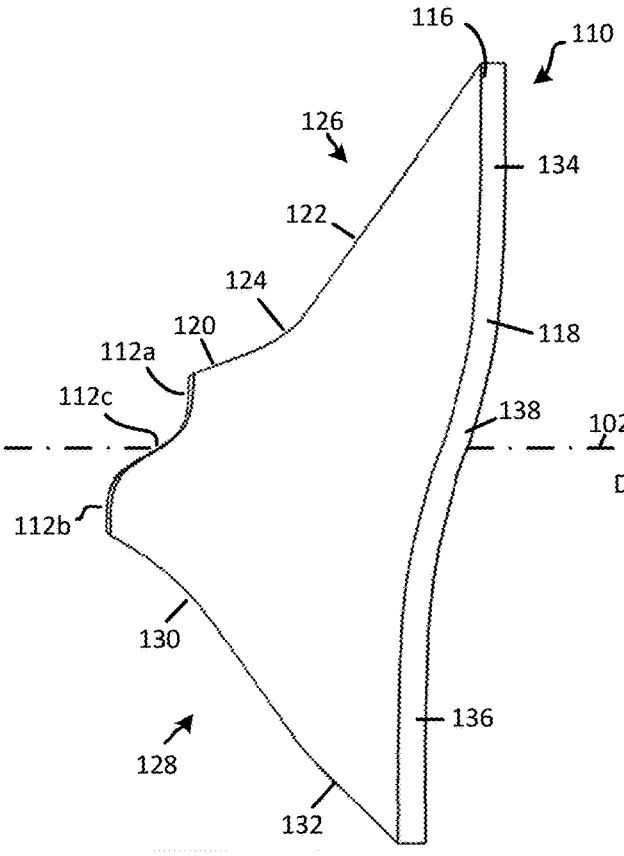
FIG. 7A illustrates a side view of a suppressor baffle, in accordance with another embodiment of the present disclosure.
Figure 7B:
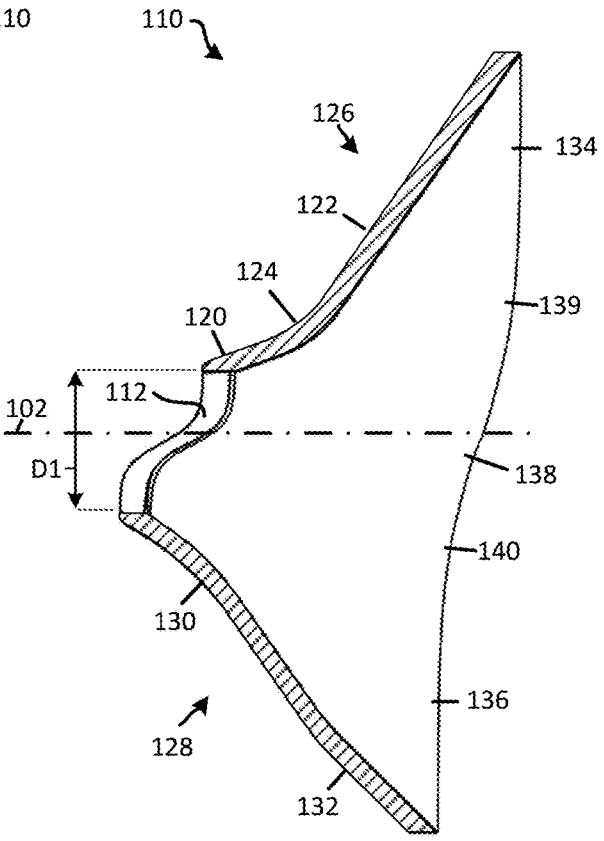
FIG. 7B illustrates a side view showing a longitudinal section of the suppressor baffle of FIG. 7A.
Figure 7C:
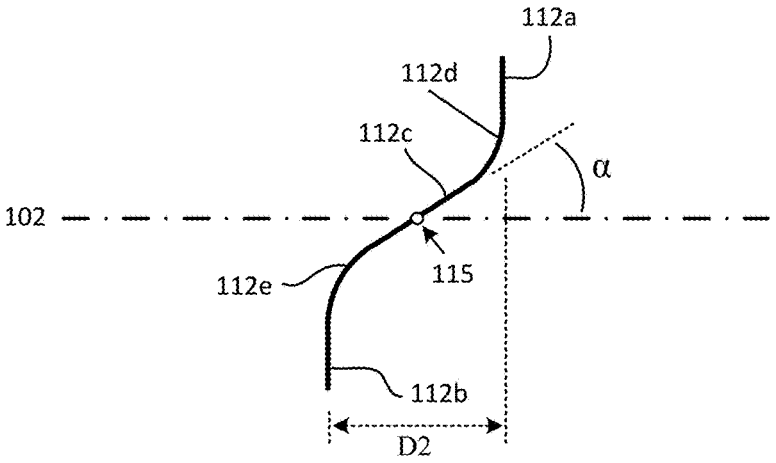
FIG. 7C illustrates a profile of the projectile opening as viewed from the side, in accordance with an embodiment of the present disclosure.
Figure 7D:
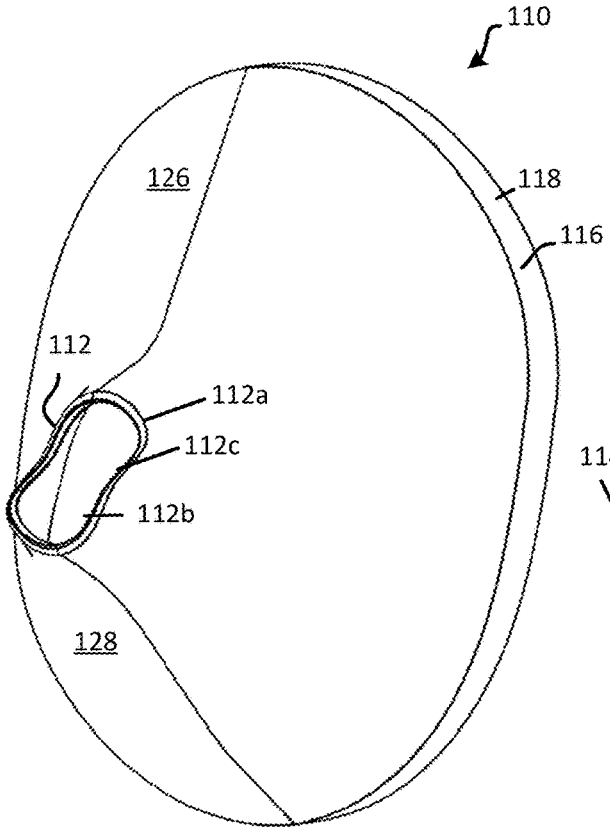
FIG. 7D illustrates a rear perspective view of the suppressor baffle of FIG. 7A.
Figure 7E:
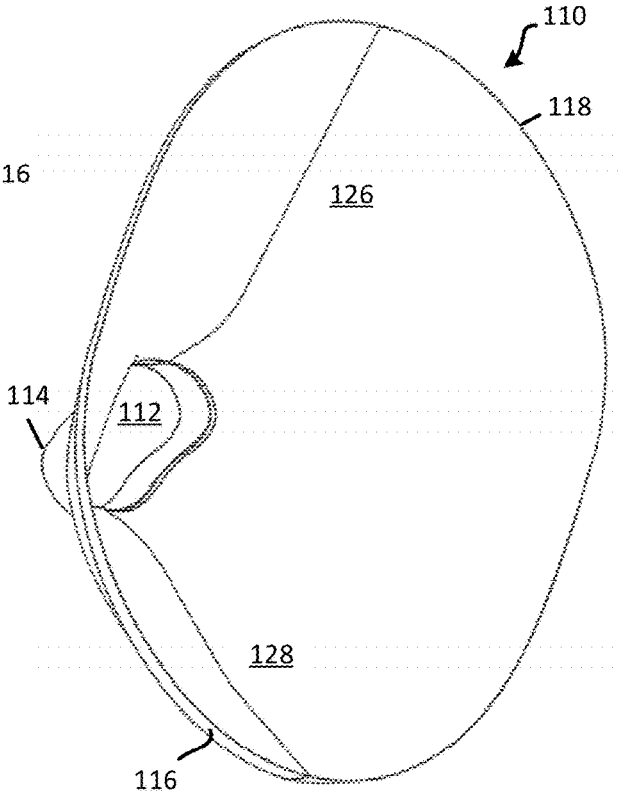
FIG. 7E illustrates a front perspective view of the suppressor baffle of FIG. 7A.

FIGS. 7A-7E illustrate views of a suppressor baffle 110, in accordance with another embodiment of the present disclosure. FIG. 7A is a side view, FIG. 7B is a side view showing a longitudinal section, FIG. 7C is a side view showing a profile of the projectile opening 112 of FIG. 7A, FIG. 7D is a rear perspective view, and FIG. 7E is a front perspective view. In this example, the baffle 110 expands along the central axis 102 from a proximal end 114 defining a projectile opening 112 to the distal end 118 having an outer rim 116. The first side 126 (e.g., upper portion) of the baffle 110 is axially offset from the second side 128 (e.g., lower portion) of the baffle 110, resulting in a sinuous or curved profile at the distal end 118 and at the proximal end 114 as viewed from the side in FIGS. 7A-7B.

For example, the second side 128 (bottom side or lower portion as shown) of the baffle cone is shifted axially rearward relative to the first side 126 (top side or upper portion as shown). In this example, the first side 126 of the curved profile includes a first portion 134 extending perpendicularly to the central axis 102 and the opposite second side 128 of the profile includes a second portion 136 extending perpendicularly to the central axis 102, the first and second portions 134, 136 are generally parallel and are axially offset. An oblique or middle portion 138 connects to the first portion 134 via a first curved portion 139 that is convex and to the second portion 136 via a second curved portion 140 that is concave.

In terms of profile shape, the first side 126 of the baffle 110 (e.g., top portion) has a relatively short first region 120 adjacent the projectile opening 112 that transitions at transition 124 to second region 122, where the first region 120 and second region 122 can have a substantially linear profile. In this example, the first side 126 curves radially outward (e.g., upward) and extends along the second region 122 at an angle of about 45° to the central axis 102. The opposite second side 128 (e.g., bottom side) includes a relatively small concave section 130 that connects to a linear section 132 that is inclined away from the central axis 102 at about 55°. Overall, the second portion approximates a linear profile between the projectile opening 112 and the outer rim 116. As can be seen in the side views of FIGS. 7A-7B, the projectile opening 112 and proximal end 114 also have an offset curve profile, where a first portion 112*a* (e.g., upper portion) and a second portion 112*b* (e.g., lower portion) of the projectile opening 112 each extends radially away from the central axis 102 in opposite directions, are generally parallel, and are axially offset. The first and second portions 112*a*, 112*b* are connected by a middle portion 112*c* with oblique orientation. As viewed from the side, such as shown in FIGS. 7A-7B, the first portion 112*a*, second portion 112*b*, and middle portion 112*c* generally form a wave shape in combination.

The projectile opening 112 has a circular shape as viewed along the central axis. This circular shape, or projected shape, has a projected diameter D1 as measured perpendicular to the central axis 102. That is, as viewed along the central axis 102, the projectile opening 112 has a circular shape with projected diameter D1.

FIG. 7C illustrates a profile of the projectile opening 112 as viewed from the side, in accordance with an embodiment of the present disclosure. The profile shown inn FIG. 7C can also be generally representative of the outer rim 116As noted such as when elongated radially, in some embodiments. The projectile opening 112 includes a first portion 112*a* extending substantially perpendicularly to the central axis 102 and a second portion 112*b* extending substantially perpendicularly to the central axis 102. The first portion 112*a* and second portion 112*b* are generally parallel to one another and are axially offset by an offset distance D2 that is in a range from 0.2 to 1.2 times the projected diameter D1 of the projectile opening 112. In some embodiments, the offset distance D2 is 0.15 inch to 0.25 inch, or about 0.2 inch, for example. A middle portion 112*c* extends obliquely to the central axis at an angle $\alpha$ of 20-50°, including 25-35°, and about 30°. The middle portion 112*c* connects to the first portion 112*a* by a first curve 112*d* of concave shape, and to the second portion 112*b* by a second curve 112*e* of convex shape. The middle portion 112*c* can be linear or a single point; the middle portion 112*c* includes one or more inflection point 115. In one embodiment, a single inflection point 115 is coincident with the central axis 102 as viewed from the side.

As noted above, the profile shown in FIG. 7C can generally represent a profile of the outer rim 116 with the first portion 134 corresponding first portion 116*a*, second portion 136 corresponding to second portion 116*b*, middle portion 138 corresponding to middle portion 116*c*, first curved portion 139 corresponding to first curve 116*d*, and second curved portion 140 corresponding to second curve 116*e*, and inflection point(s) 115. In one embodiment, the first portion 134 and second portion 136 of the outer rim 116 have an axial offset distance D of 0.15 inch to 0.25 inch, or about 0.2 inch, for example. The axial offset of the outer rim 116 can be the same or different compared to the axial offset of the projectile opening 112.

Figure 8A:
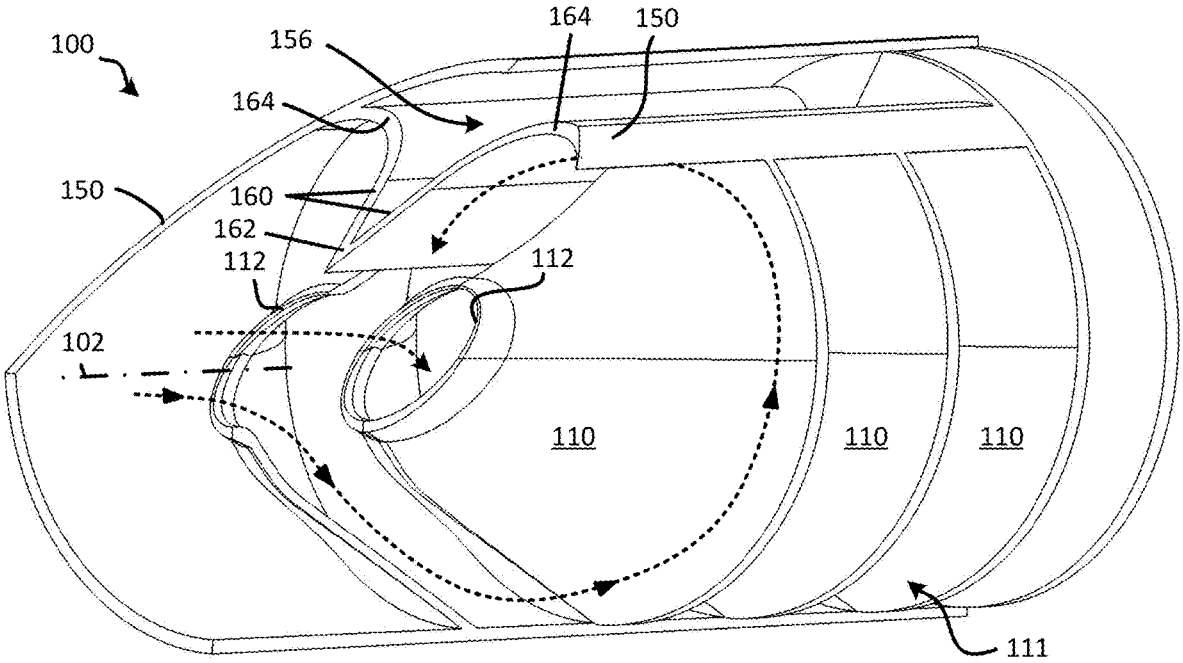
FIG. 8A illustrates a perspective and partial cutaway view showing part of a suppressor assembly, in accordance with one embodiment.
Figure 8B:
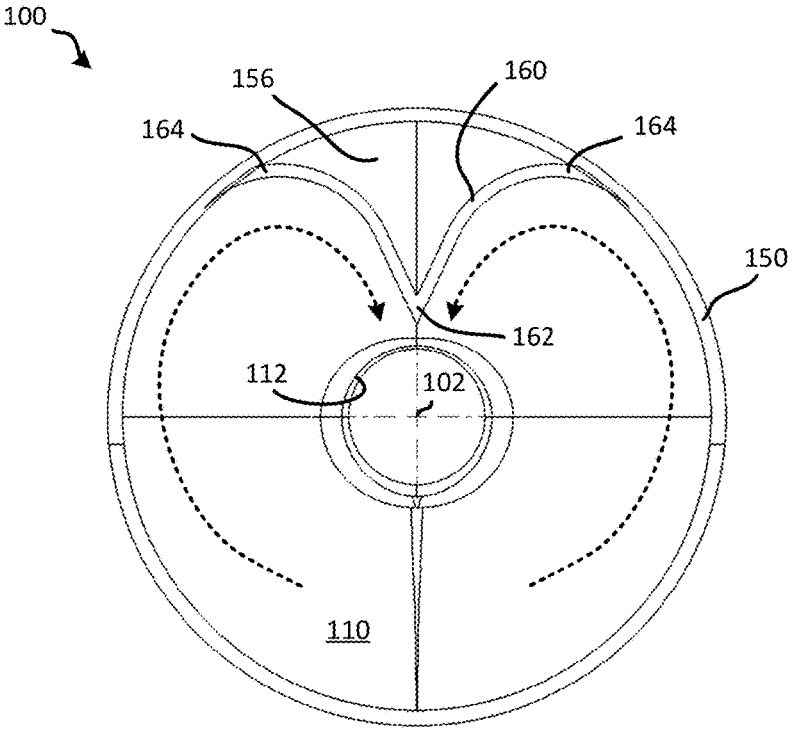
FIG. 8B illustrates an end view looking distally along a central axis of the suppressor assembly of FIG. 8A.
Figure 8C:
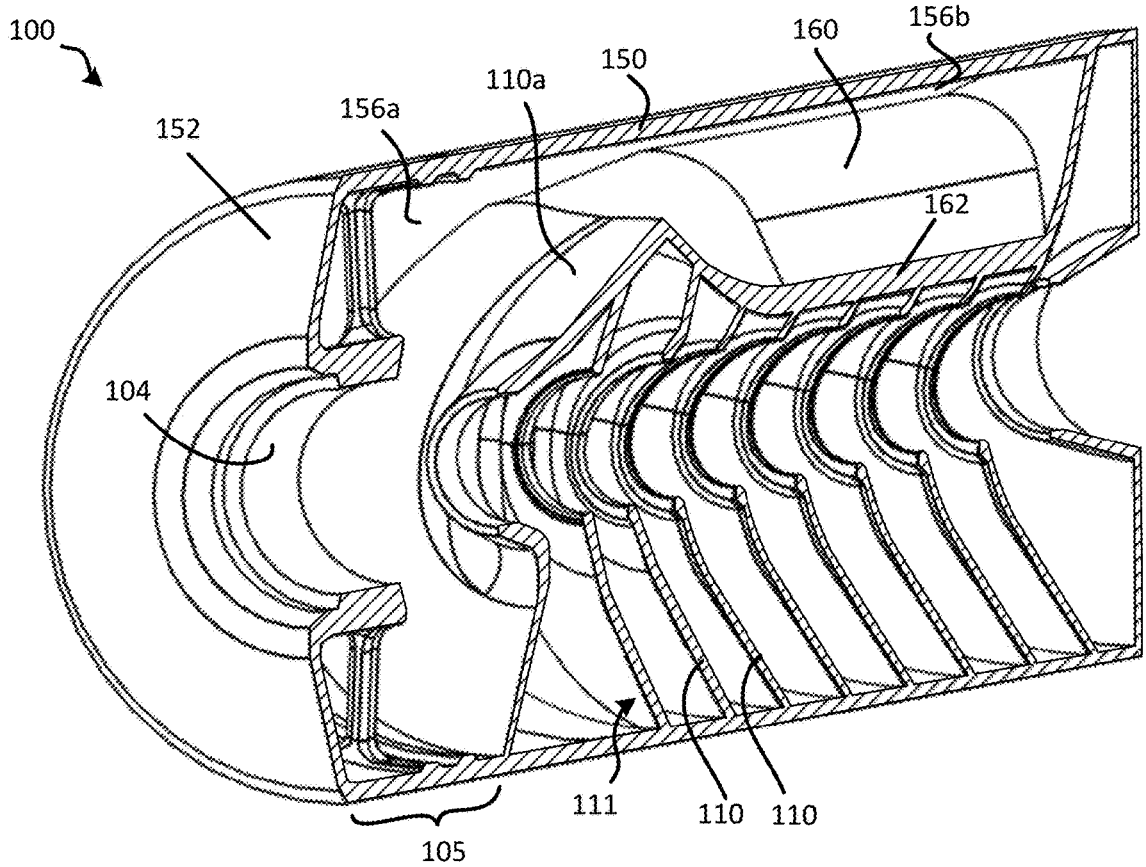
FIG. 8C illustrates a side and rear perspective view showing a longitudinal section through a suppressor assembly, in accordance with another embodiment.
Figure 8D:
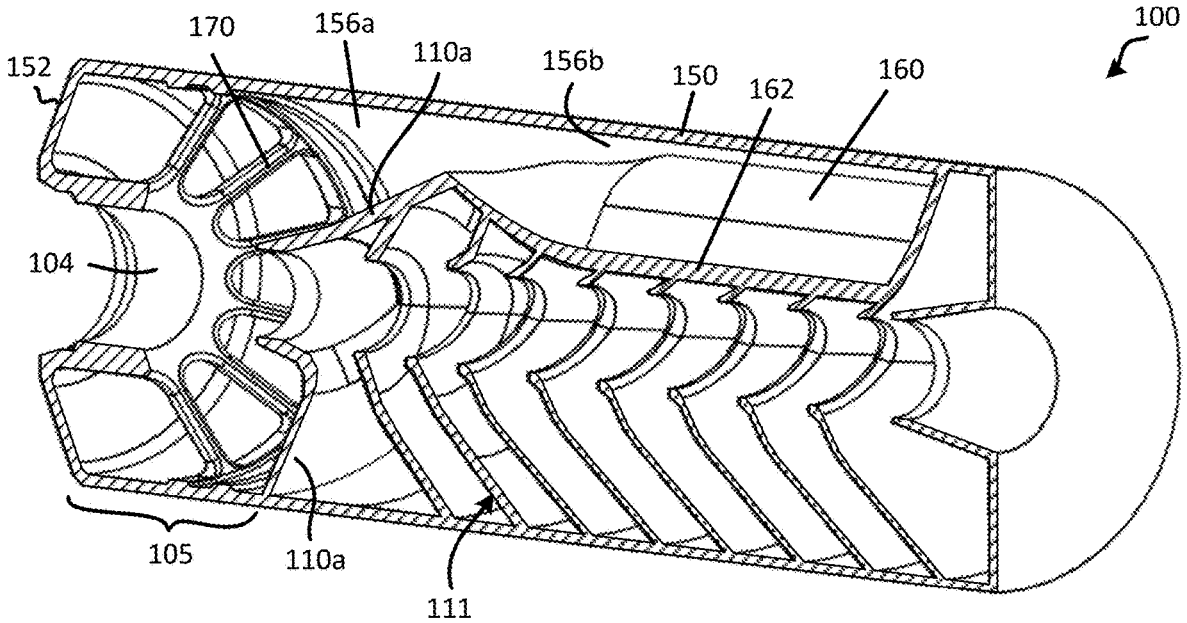
FIG. 8D illustrates a side and front perspective view showing a longitudinal section of a suppressor assembly, in accordance with another embodiment.
Figure 8E:
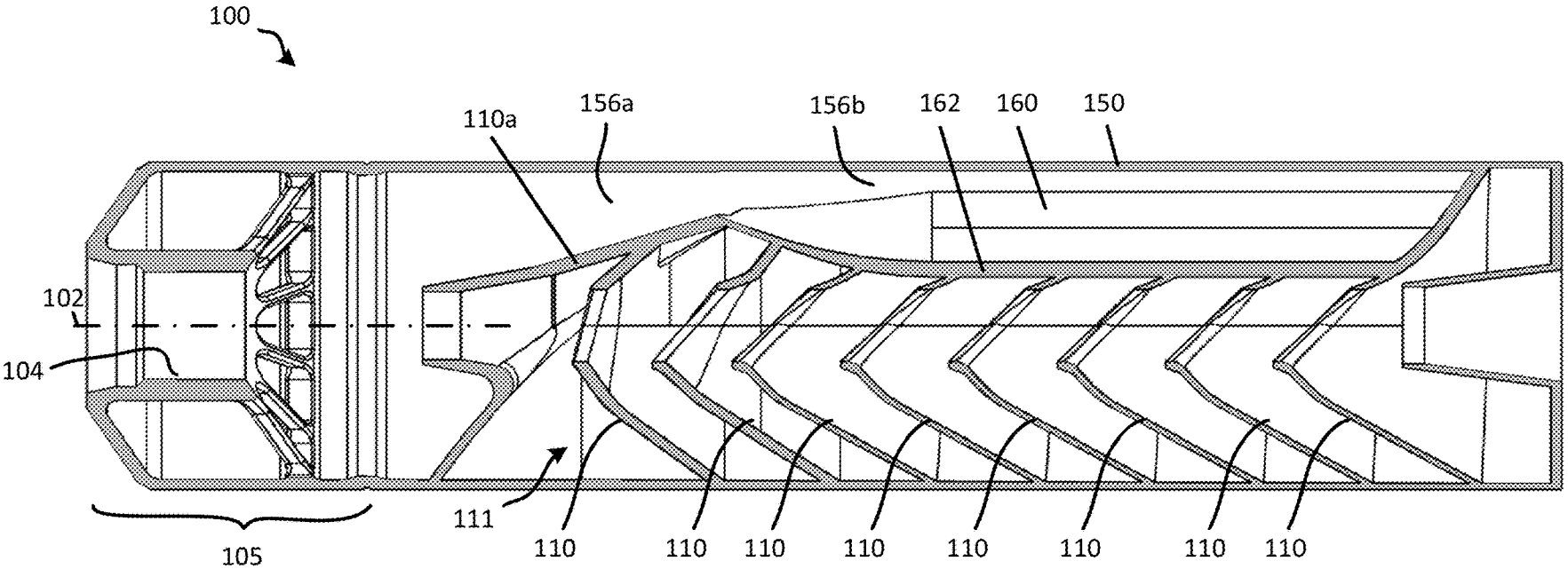
FIG. 8E illustrates a side view showing the longitudinal section of FIG. 8D.

Turning now to FIGS. 8A-8E, a suppressor assembly 100, or part thereof, is shown in various views. FIG. 8A illustrates a perspective, partial cutaway view showing part of a suppressor assembly 100, in accordance with one embodiment. FIG. 8B illustrates an end view looking distally along a central axis of the suppressor assembly 100 of FIG. 8A. FIG. 8C illustrates a side and rear perspective view showing a longitudinal section through a suppressor assembly 100, in accordance with another embodiment. The suppressor assembly 100 of FIG. 8C has a proximal wall 152 that defines an opening 104 configured for attachment to a barrel or adapter on a firearm barrel (not shown). In some embodiments, the opening 104 can be threaded. FIG. 8D illustrates a side and front perspective view showing a longitudinal section of a suppressor assembly 100, in accordance with another embodiment. FIG. 8E illustrates a side view showing the longitudinal section of FIG. 8D.

The suppressor assembly 100 of FIGS. 8A-8E provides enhanced sound attenuation due to features such as an increased volume of the blast chamber 156, enhanced off-axis gas flows, and/or further slowed expansion of combustion gases. A suppressor assembly 100 as shown in these examples is best suited for bolt-action firearms due to increased back pressure in the suppressor, but could be used with any type of action, including semiautomatic and fully automatic rifles.

The suppressor assembly 100 shown in FIGS. 8D-8E includes a proximal end portion 105 that includes the proximal wall and opening 104. In some embodiments, the proximal end portion 105 can be a separate part of the suppressor assembly 100, such as being configured as a mount that threads onto a firearm barrel and that threadably connects to the body of the suppressor assembly 100. In some embodiments, the proximal end portion 105 is formed as an integral part of the suppressor assembly 100. For example, the suppressor assembly 100 can be manufactured using additive manufacturing, such as direct metal laser sintering (DMLS) or other suitable technique.

The suppressor assembly 100 of FIGS. 8A-8E includes a baffle stack 111 contained within an outer housing 150. Baffles 110 of the baffle stack 111 include a partition or wall 160 extending rearwardly. For example, the wall 160 has a V-shape that extends axially along and intersects at least part of the baffle stack 111. The V-shape defines a vertex 162 that is directed towards the central axis 102 and towards the projectile opening 112 of baffles 110. The wall 160 extends outward in the V-shape from the vertex 162 to radially outer portions 164 that connect to the outer housing 150. As shown in FIG. 8B, for example, the radially outer portions 164 of the wall 160 can have an arcuate shape that provides a smooth transition with the inside surface of the outer housing 150, which can be cylindrical. Also, the wall 160 can have other profiles as viewed axially, such as a U-shape, a W-shape, or other shape. In one such embodiment, the radially outer portions 164 of the wall 160 connect tangentially or near-tangentially (e.g., at an angle of 170-180° to the outer housing 150. In other embodiments, the radially outer portions 164 can connect to the outer housing 150 so as to define an angle from 90-180° with the outer housing 150. In such embodiments, the wall 160 having a V-shape can have radially outer portions 164 of an arcuate or planar geometry. For example, the wall 160 includes two planar portions that meet at the vertex 162 and extend linearly to the outer housing 150 as viewed from the end, such as the view of FIG. 8B. Thus, while an arcuate transition between the outer housing 150 and the V-shaped wall 160 efficiently directs gas flows toward the projectile opening 112, such transition is not required in all embodiments.

Note that the vertex 162 is positioned radially outside of the projectile opening 112 of the baffles 110. As a result, gases may be directed around the outside of the baffle 110, along the V-shaped wall 160 in a radially inward direction, and toward the projectile opening 112. Following such a flow path, combustion gases would collide with gases flowing along the central axis 102, causing off-axis gas flows that fill radially outer portions of the suppressor assembly 100. FIGS. 8A and 8B show example gas flow paths with arrows drawn with broken lines. Due to the sloped plane of the projectile opening 112, combustion gases tend to flow radially away from a given projectile opening 112 (e.g., downward as shown here). Gases then are directed along the outer housing 150 and along the V-shaped wall 160 toward the next projectile opening 112, enhancing the off-axis flow patterns of combustion gases.

Part of the blast chamber 156 is defined between the V-shaped wall 160 and the outer housing 150. As can be seen in FIGS. 8C-8D, for example, the blast chamber 156 includes a proximal portion 156*a* located proximally of the first baffle 110*a* (also referred to as the blast baffle). A distal portion 156*b* of the blast chamber 156 is between the V-shaped wall 160 and the outer housing 150 and extends along at least part of the baffle stack 111. In this example, the V-shaped wall 160 connects to the first baffle 110*a* and extends axially therefrom, thereby defining the blast chamber 156 with the proximal portion 156*a* and the distal portion 156*b*. Other baffles 110 of the baffle stack 111 are then contained in the chamber between the V-shaped wall 160 and outer housing 150.

Figure 9A:
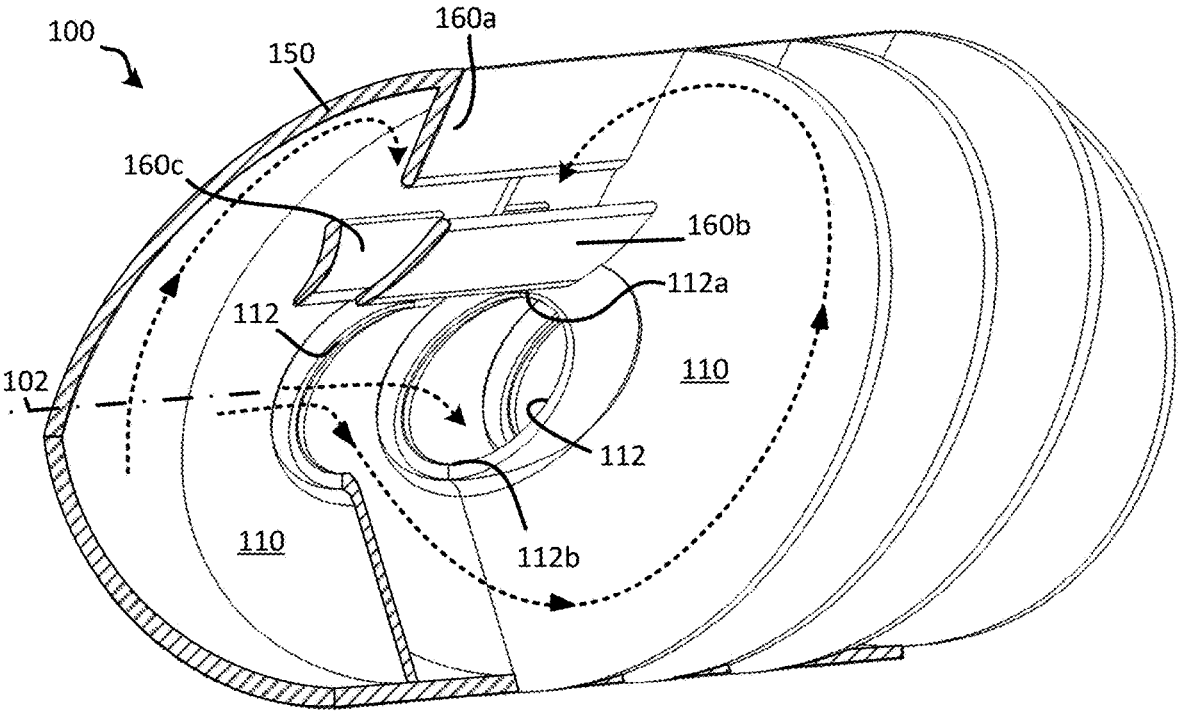
FIG. 9A illustrates a perspective and partial cutaway view showing part of a suppressor assembly, in accordance with another embodiment of the present disclosure.
Figure 9B:
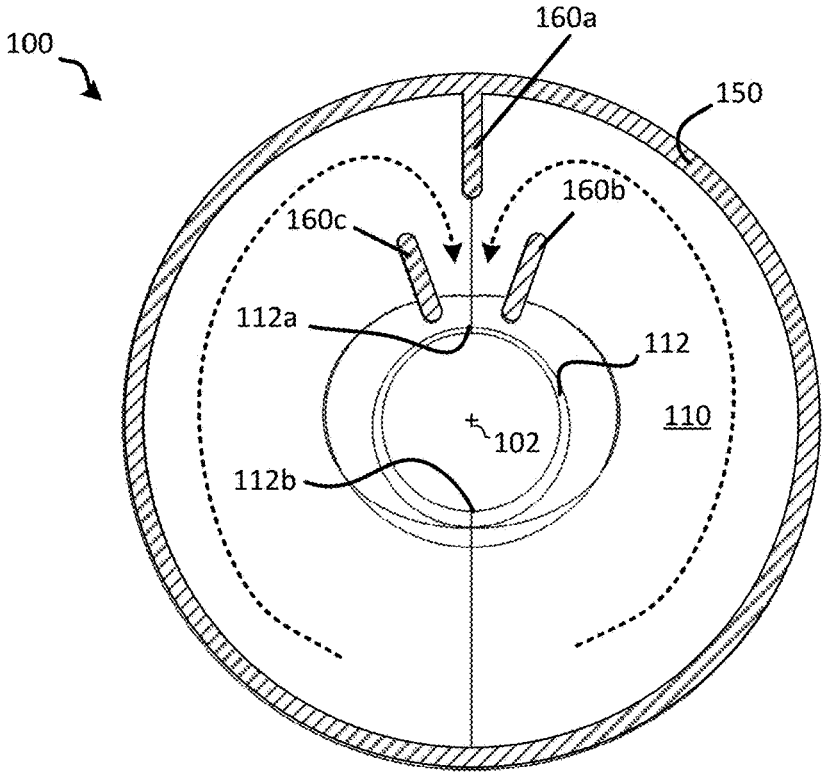
FIG. 9B illustrates an end view looking distally along a central axis of the suppressor assembly of FIG. 9A.
Figure 9C:
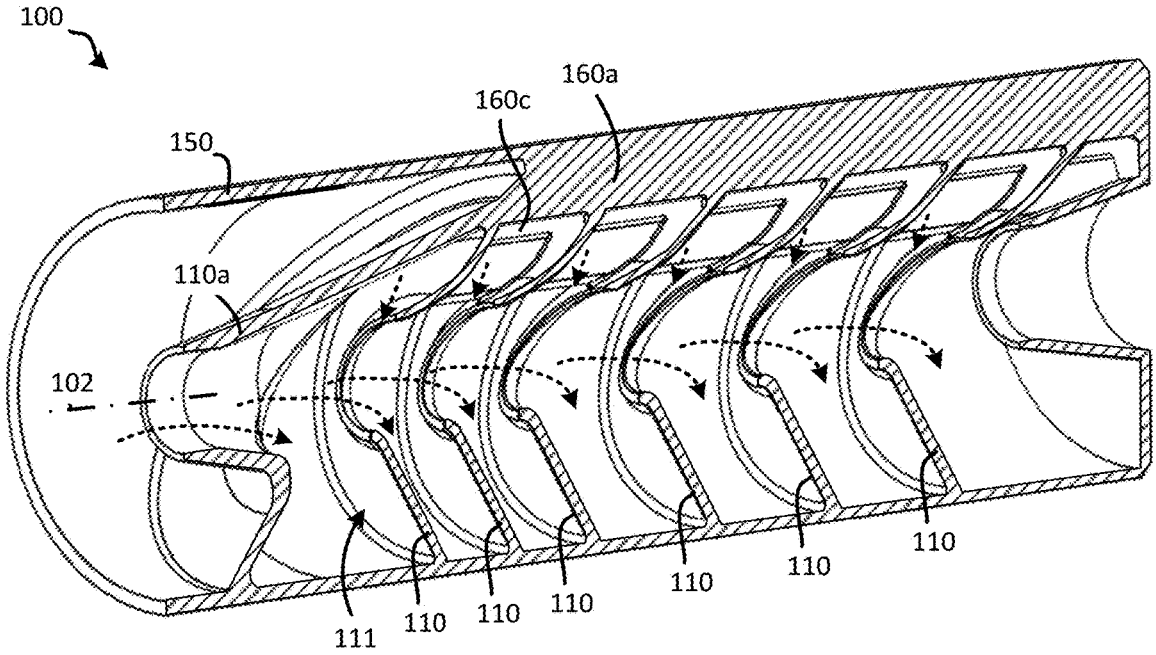
FIG. 9C illustrates a side and rear perspective view showing a longitudinal section through a suppressor assembly, in accordance with another embodiment of the present disclosure.
Figure 9D:
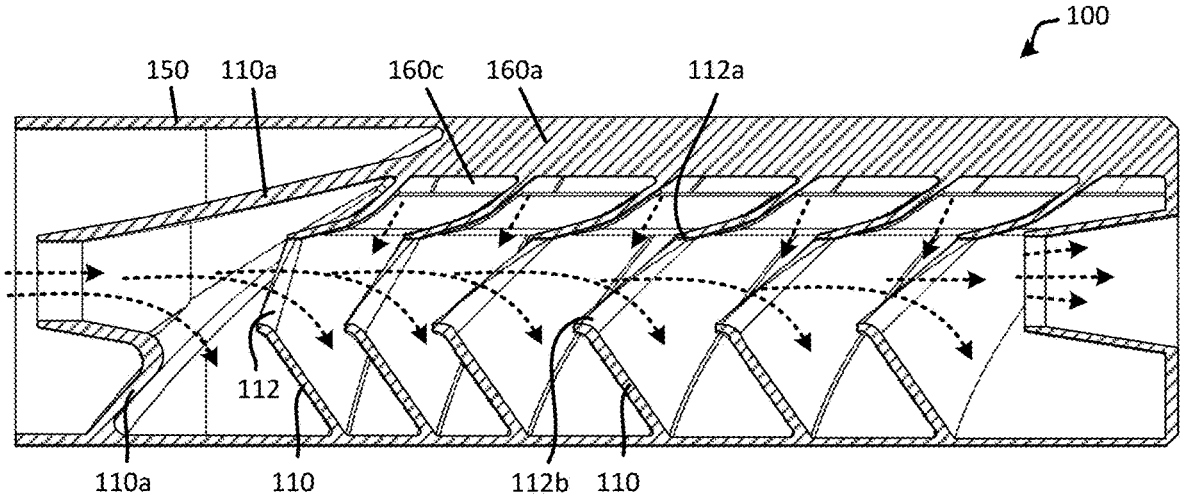
FIG. 9D illustrates a side view showing the longitudinal section of FIG. 9C.

Turning now to FIGS. 9A-9D, a suppressor assembly 100, or part thereof, is shown in various views. FIG. 9A illustrates a perspective, partial cutaway view showing part of a suppressor assembly 100, in accordance with one embodiment. FIG. 9B illustrates an end view looking distally along a central axis 102 of the suppressor assembly 100 of FIG. 9A. FIG. 9C illustrates a side and rear perspective view showing a longitudinal section through a suppressor assembly 100, in accordance with another embodiment. FIG. 9D illustrates a side view showing the longitudinal section of FIG. 9C. The suppressor assembly 100 of FIGS. 9A-9D include a baffle stack 111 contained within an outer housing 150, where baffles 110 of the baffle stack 111 are intersected by one or more walls 160 that extend radially inward between the outer housing 150 and the projectile opening.

In these examples, the baffle stack 111 includes a plurality of walls 160 arranged to direct combustion gases towards the projectile opening 112 of at least one baffle of the baffle stack 111. In some embodiments, one or more of the walls 160 of the plurality of walls 160 extends along the central axis 102 and intersects baffles 110 of the baffle stack. In other embodiments, each baffle 110 has one or more walls 160 connected to the baffle 110 and extending rearwardly. As with some embodiments discussed above, the projectile opening 112 is in an entrance plane 113 that is inclined to the central axis 102 such that the projectile opening 112 has a first portion 112*a* positioned distally and a second portion 112*b* positioned proximally. The walls 160 are arranged adjacent the first portion 112*a* of the projectile opening 112 so as to direct combustion gases across the central axis 102. As shown in FIG. 9A, for example, the first portion 112*a* of the projectile opening 112 is at the top and the walls 160 are directed to enhance downward flow of combustion gases as they pass through the projectile opening 112. Note that a suppressor assembly 100 incorporating these features is not limited to any particular rotational orientation about the central axis 102.

The suppressor assembly 100 of FIGS. 9C-9D provides enhanced sound attenuation due to features such as enhanced off-axis gas flows and/or further slowed expansion of combustion gases. A suppressor assembly 100 as shown in these examples is best suited for bolt-action firearms due to increased back pressure in the suppressor, but could be used with any type of action, including semiautomatic and fully automatic rifles. The suppressor assembly 100 of FIGS. 9C-9D can be manufactured using additive manufacturing, such as direct metal laser sintering (DMLS) or other suitable technique.

In the example shown in FIG. 9A, the walls 160 include a first wall 160*a* that extends radially inward from the outer housing 150 towards the central axis 102 and projectile opening 112. Second wall 160*b* and third wall 160*c* extend inward toward the first portion 112*a* of the projectile opening 112*a* and/or toward the central axis 102, although the second and third walls 160*b*, 160*c* are not connected to the outer housing 150. Instead, the second wall 160*b* and third wall 160*c* are spaced radially from the outer housing 150. One or more of the walls 160 can extend continuously through baffles 110. Alternately, some or all of the walls 160 can be segmented such that individual baffles 110 the walls 160 are connected to the baffle 110 and extend rearwardly part way towards the next proximally located baffle 110, but the walls 160 do not connect two adjacent baffles 110.

As can be seen in FIGS. 9C-9D, the first wall 160*a* extends axially and connects the outer housing 150 to the first baffle 110*a*. Part of the third wall 160*c* is visible behind the first wall 160*a*. Example gas flow paths are shown with arrows drawn using broken lines, where gases tend to flow away from the first portion 112*a* of the projectile opening 112 (e.g., downward). This downward or off-axis flow path is enhanced by combustion gases being directed by walls 160 towards the projectile opening 112. Each of the walls 160*a*-160*c* can have a planar or arcuate shape. Note also that the first wall 160*a* is shown as being planar; however, it is contemplated that the first wall 160*a* can have a V-shape or other shape as discussed above with reference to FIGS. 8A-8E.

FURTHER EXAMPLE EMBODIMENTS

The following examples pertain to further embodiments, from which numerous permutations and configurations will be apparent.

Example 1 is a suppressor baffle comprising a cone portion expanding along a central axis from a proximal end defining a projectile opening to an open distal end with an outer rim. The projectile opening is in an entrance plane oriented obliquely to the central axis. A first volume between a first side of the cone portion and a central plane that includes the central axis is smaller than a second volume between an opposite second side of the cone portion and the central plane. At least part of an outer surface of the second side of the cone portion has a convex profile and as viewed along the central plane from a side of the suppressor baffle.

Example 2 includes the suppressor baffle of Example 1, where the projectile opening has a circular shape as viewed along the central axis.

Example 3 includes the suppressor baffle of Examples 1 or 2, wherein an outer surface of the first side of the cone portion generally has a concave profile as viewed along the central plane from a side of the suppressor baffle.

Example 4 includes the suppressor baffle of any one of Examples 1-3, where a majority portion of the outer surface of the second side of the cone portion has a convex profile as viewed along the central plane from a side of the suppressor baffle.

Example 5 includes the suppressor baffle of any one of Examples 1-3, where a majority portion of the outer surface of the second side of the cone portion has a linear or convex profile as viewed along the central plane from a side of the suppressor.

Example 6 includes the suppressor baffle of any one of Examples 4-5, wherein the outer surface of the second side includes a concave portion adjacent the projectile opening.

Example 7 includes the suppressor baffle of any one of Examples 1-6, where the outer rim is circular and coaxially arranged with the central axis.

Example 8 includes the suppressor baffle of any one of Examples 1-7 and further includes one or more walls connected to the baffle and extending rearwardly, the one or more walls arranged adjacent a distal portion of the projectile opening.

Example 9 includes the suppressor baffle of Example 8, where the one or more walls includes a V-shaped wall having a vertex directed towards the projectile opening.

Example 10 is a suppressor baffle that includes a cone expanding along a central axis from a proximal end that defines a projectile opening to an open distal end having an outer rim. The projectile opening is in an entrance plane oriented obliquely to the central axis. A first volume between a first side of the cone and a central plane that includes the central axis is smaller than a second volume between an opposite second side of the cone and the central plane. The first side of the cone is shifted or offset axially with respect to the second portion of the cone.

Example 11 includes the suppressor baffle of Example 10, where the projectile opening has a wave shape as viewed from a side of the cone, the wave shape including a first end portion, a middle portion, and a second end portion. In addition, the first end portion and second end portion extend substantially radially to the central axis, the middle portion is oriented obliquely to the central axis at an inflection point, the middle potion connects to the first end portion with a concave curve, and the middle portion connects to the second end portion with a convex curve.

Example 12 includes the suppressor baffle of Example 11, where the middle portion defines an angle from 20-50° with central axis at the inflection point.

Example 13 includes the suppressor baffle of Example 12, where the angle is from 25-35° with central axis at the inflection point.

Example 14 includes the suppressor baffle of any one of Examples 11-13, where the inflection point is coincident with the central axis as viewed along the central plane from a side of the suppressor baffle.

Example 15 includes the suppressor baffle of any one of Examples 11-14, where the projectile opening has a projected diameter that is perpendicular to the central axis, and wherein the first end portion is axially offset from the second end portion by an entrance offset distance of 0.2 to 1.2 times the projected diameter.

Example 16 includes the suppressor baffle of any one of Examples 11-14, where the entrance offset distance is from 0.15 to 0.25 inch, or about 0.2 inch.

Example 17 includes the suppressor baffle of any one of Examples 11-16, where a profile of the outer rim has a first outer rim portion extending radially, a second outer rim portion extending radially, and a middle rim portion connected to the first outer rim portion with a convex curve and to the second outer rim portion by a concave curve.

Example 18 includes the suppressor baffle of Example 17, where the first outer rim portion is axially offset from the second outer rim portion by a rim offset distance of 0.2 times to 1.2 times the projected diameter of the projectile opening.

Example 19 includes the suppressor baffle of Example 17, where the rim offset distance is 0.15 to 0.25 inch, or about 0.2 inch.

Example 20 includes the suppressor baffle of any one of Examples 11-16, where the outer rim has a circular shape that is coaxially arranged with the central axis.

Example 21 includes the suppressor baffle of any one of Examples 11-20 and further includes one or more walls extending axially rearward from the first side of the baffle cone.

Example 22 includes the suppressor baffle of Example 21, where the one or more walls includes a V-shaped wall having a vertex directed towards the projectile opening.

Example 23 is a suppressor assembly including an outer housing and a baffle stack within the outer housing and having three or more baffles arranged along a central axis. Individual baffles have a cone portion expanding along a central axis from a proximal end to an open distal end having an outer rim that is connected to the outer housing. The proximal end defines a projectile opening contained in a plane that is oriented obliquely to the central axis so as to define an angle $\alpha$ with the central axis as viewed from a side of the baffle stack. The three or more baffles include a first baffle defining a first angle $\alpha 1<90°$, a second baffle located distally of the first baffle and defining a second angle $\alpha 2<\alpha 1$, and a third baffle located distally of the second baffle and defining a third angle $\alpha 3<\alpha 2$.

Example 24 includes the suppressor assembly of Example 23, where individual baffles have a first volume between a first side of the cone portion and a central plane that includes the central axis, and individual baffles have a second volume between an opposite second side of the cone portion and the central plane, the first volume being smaller than the second volume.

Example 25 includes the suppressor assembly of Example 23 or 24, where the projectile opening of individual baffles has a circular shape as viewed along the central axis.

Example 26 includes the suppressor assembly of any one of Examples 23-25, where an outer surface of the first side of the cone portion of individual baffles has a generally concave profile as viewed along the central plane from a side of the baffle stack.

Example 27 includes the suppressor assembly of any one of Examples 23-26, where a majority of the outer surface of the second side of the cone portion of individual baffles has a convex profile as viewed along the central plane from a side of the baffle stack.

Example 28 includes the suppressor assembly of any one of Examples 19-22, where a majority portion of the outer surface of the second side of the cone portion of individual baffles is linear or convex as viewed along the central plane from a side of the baffle stack.

Example 25 includes the suppressor assembly of any one of Examples 23-24, where the outer surface of the second side includes a concave portion adjacent the projectile opening.

Example 26 includes the suppressor assembly of any one of Examples 19-25, wherein the outer rim is circular and coaxially arranged with the central axis.

Example 27 includes the suppressor assembly of any one of Examples 23-26 and further includes one or more walls extending axially and intersecting the three of more baffles of the baffle stack.

Example 28 includes the suppressor assembly of Example 27, where the one or more walls includes a first wall connected to and extending radially inward from the outer housing and additional walls spaced from the outer housing and positioned between the outer housing and the projectile opening, the additional walls extending towards the projectile opening.

Example 29 includes the suppressor assembly of Example 27 or 28, where the one or more walls includes a V-shaped wall having a vertex directed towards the projectile opening and having radially outer portions connected to the outer housing.

Example 30 includes the suppressor assembly of Example 29, where the suppressor assembly defines part of a blast chamber between the V-shaped wall and the outer housing, the blast chamber in fluid communication with an entrance to the suppressor assembly.

Example 31 is a baffle stack having three or more suppressor baffles as defined in any one of Examples 1-22.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The invention claimed is:

1. A suppressor baffle comprising:

a baffle cone expanding along a central axis from a proximal end that defines a projectile opening to an open distal end having an outer rim, wherein the projectile opening is in an entrance plane oriented obliquely to the central axis, and wherein a first volume between a first side of the cone and a central plane that includes the central axis is smaller than a second volume between an opposite second side of the baffle cone and the central plane; and one or more walls extending axially rearward from the first side of the baffle cone, the one or more walls having a radially outer portion that extends axially rearward from the outer rim, the outer portion configured to connect axially along an outer housing, the one or more walls also extending radially inward from the outer portion toward the projectile opening;

wherein the one or more walls includes at least two walls joining at a vertex directed towards the projectile opening; and wherein the first side of the baffle cone is shifted distally with respect to the second side of the baffle cone.

2. The suppressor baffle of claim 1, wherein:

the projectile opening has a wave shape as viewed from a side of the cone, the wave shape including a first end portion, a middle portion, and a second end portion;

the first end portion and second end portion extend substantially radially to the central axis;

the middle portion is oriented obliquely to the central axis at an inflection point;

the middle potion connects to the first end portion with a concave curve; and the middle portion connects to the second end portion with a convex curve.

3. The suppressor baffle of claim 2, wherein the middle portion defines an angle from 20-50° with central axis at the inflection point.

4. The suppressor baffle of claim 3, wherein the angle is from 25-35° with central axis at the inflection point.

5. The suppressor baffle of claim 4, wherein the inflection point is coincident with the central axis as viewed from a side of the suppressor baffle.

6. The suppressor baffle of claim 1, wherein a profile of the outer rim has a first outer rim portion extending radially, a second outer rim portion extending radially, and a middle rim portion connected to the first outer rim portion with a convex curve and to the second outer rim portion by a concave curve.

7. The suppressor baffle of claim 1, wherein the projectile opening has a projected diameter that is perpendicular to the central axis, and wherein the first end portion is axially offset from the second end portion by an entrance offset distance of 0.2 to 1.2 times the projected diameter.

8. The suppressor baffle of claim 7, wherein the entrance offset distance is from 0.15 to 0.25 inch.

9. The suppressor baffle of claim 7, wherein the first outer rim portion is axially offset from the second outer rim portion by a rim offset distance from 0.2 to 1.2 times a projected diameter of the projectile opening.

10. A suppressor assembly comprising:

an outer housing; and a baffle stack within the outer housing and having three or more baffles arranged along a central axis, individual baffles comprising a cone portion expanding along the central axis from a proximal end to an open distal end having an outer rim connected to the outer housing;

wherein the proximal end of the cone portion defines a projectile opening contained in a plane that is oriented obliquely to the central axis so as to define an angle $\alpha$ with the central axis as viewed from a side of the baffle stack; and wherein the three or more baffles include a first baffle defining a first angle $\alpha 1<90°$, a second baffle located distally of the first baffle and defining a second angle $\alpha 2<\alpha 1$, and a third baffle located distally of the second baffle and defining a third angle $\alpha 3<\alpha 2$.

11. The suppressor assembly of claim 10, wherein individual baffles have a first volume between a first side of the cone portion and a central plane that includes the central axis, and individual baffles have a second volume between an opposite second side of the cone portion and the central plane, the first volume being smaller than the second volume.

12. The suppressor assembly of claim 10, wherein the projectile opening of individual baffles has a circular shape as viewed along the central axis.

13. The suppressor assembly of claim 10, further comprising:

one or more walls extending axially and intersecting the three of more baffles of the baffle stack.

14. The suppressor assembly of claim 13, wherein the one or more walls includes:

a first wall connected to and extending radially inward from the outer housing; and additional walls spaced from the outer housing and positioned between the outer housing and the projectile opening, the additional walls extending towards the projectile opening.

15. The suppressor assembly of claim 13, wherein the one or more walls includes a V-shaped wall having a vertex directed towards the projectile opening and having radially outer portions connected to the outer housing.

16. The suppressor assembly of claim 15, wherein the suppressor assembly defines part of a blast chamber between the V-shaped wall and the outer housing, the blast chamber in fluid communication with an entrance to the suppressor assembly.

* * * * *